US005647141A

United States Patent [19]

Hanaya

[11] Patent Number: 5,647,141

[45] Date of Patent: Jul. 15, 1997

[54] PROCESS AND APPARATUS FOR DRYING SHEET MATERIALS

[75] Inventor: Morimasa Hanaya, Mishima, Japan

[73] Assignee: Tokushu Paper Mfg. Co., Ltd., Shizuoka-ken, Japan

[21] Appl. No.: 643,016

[22] Filed: May 2, 1996

Related U.S. Application Data

[62] Division of Ser. No. 340,383, Nov. 15, 1994, Pat. No. 5,553,392.

[30] Foreign Application Priority Data

| | | | |
|---|---|---|---|
| Nov. 15, 1993 | [JP] | Japan | 5-309774 |
| Jun. 6, 1994 | [JP] | Japan | 6-147059 |
| Jun. 6, 1994 | [JP] | Japan | 6-147060 |
| Oct. 17, 1994 | [JP] | Japan | 6-278508 |
| Oct. 18, 1994 | [JP] | Japan | 6-278473 |
| Oct. 27, 1994 | [JP] | Japan | 6-287469 |

[51] Int. Cl.[6] ..... F26B 11/02

[52] U.S. Cl. ..... 34/115; 34/116

[58] Field of Search ..... 34/115, 114, 116, 34/117, 120, 121, 122

[56] References Cited

U.S. PATENT DOCUMENTS

| | | | |
|---|---|---|---|
| 2,477,949 | 8/1949 | Amonsen | 34/601 |
| 2,835,047 | 5/1958 | Fleissner et al. | 34/122 |
| 3,163,502 | 12/1964 | Justus et al. | 34/114 |
| 3,576,078 | 4/1971 | Holt | 34/114 |
| 3,956,832 | 5/1976 | Justus | 34/115 |
| 4,103,434 | 8/1978 | Walker | 34/114 |
| 4,116,022 | 9/1978 | Lopata et al. | 34/116 |
| 4,124,941 | 11/1978 | Birke et al. | 34/114 |

FOREIGN PATENT DOCUMENTS 8509529 10/1996 Japan .

*Primary Examiner*—Henry A. Bennett
*Assistant Examiner*—Dinnatia Doster
*Attorney, Agent, or Firm*—Oblon, Spivak, McClelland, Maier & Neustadt, P.C.

[57] ABSTRACT

An apparatus for drying a wet sheet material such as a paper web is presented. The apparatus is provided with a suitable number of dryer cylinders operating in conjunction with a plurality of steam blast ports disposed adjacent to the dryer cylinders. A vertically movable canopy hood and a middle hood having sheet entry/exit opening and a door opening device are provided. The wet sheet material is held between two endless fabric belts, and passed through the dryer cylinders alternatively via suction fabric rolls, fabric rolls and fabric tension rolls. The drying process is carried out in an atmosphere of superheated steam of over 100° C. inside the canopy hood and the middle hood, and the steam generated from the wet sheets is recirculated through an exhaust screen, a super heated steam circulating fan, an adiabatic compressor and a supply duct. Another atmosphere of heated moist air having a dew point of at least 80° C. is also employed.

21 Claims, 21 Drawing Sheets

PROCESS AND APPARATUS FOR DRYING SHEET MATERIALS

This is a division, of application Ser. No. 08/340,383 filed on Nov. 15, 1994 now U.S. Pat. No. 5,553,392.

BACKGROUND OF THE INVENTION

1. Field of the Invention

The present invention relates in general to a novel apparatus for drying sheet materials, such as paper and some types of wet process-nonwoven fabric, which are susceptible to breakage in the wet conditions as opposed to woven fabric, and which are subjected to intra-fiber contraction due to the formation of inter-fiber, hydro-bonding caused by vaporization of moisture during drying process.

2. Description of the Prior Art

A typical method for drying a paper web on a paper-making machine generally involves steam-heated dryer cylinders. In recent years, a closed dryer hood insulated by suitable insulating materials is installed so as to surround dryer cylinders in series. A large volume of high temperature, low humidity air (heated with exhaust steam and fresh stream) is blown into the dryer hood, and the moisture released from the paper web is removed in a moving air stream kept at no greater than a 70–80% saturation curve to prevent condensation inside the hood. However, the technique is energy-intensive because of the blowers needed to handle a large amount of process air, and is wasteful of energy also because the moisture-laden air is largely exhausted to the atmosphere except for a minor use for reheating of the fresh air supply.

Another technique developed in recent years involves the use of two heated and cooled endless steel belts holding a wet paper web therebetween. The moisture vaporized by the heated belt is immediately condensed on the cooled belt, and the condensate is drained onto an endless fabric belt. Thus, the wet paper web is dried at a temperature in excess of 100° C. while restraining the expansion/contraction thereof. The paper dried by this technique is of high quality, but the technique requires a large quantity of cooling water, which can only be recycled as warm water. Therefore, the economy of the process is quite inferior.

For drying of thin papers, such as toilet and tissue papers, a wet web of paper is dried on a single large-diameter dryer cylinder, called a Yankee dryer, which has a canopy hood disposed so as to surround a top half portion of the cylinder. Fresh air and recycled moisture-laden air are heated to a high-temperature gas at about 300°–450° C., and are blown towards the exposed side of the wet paper web at a high speed of 70–120 m/s. The product has a Yankee glazed surface on one side only, and the other side remains rough. The use of manufactured product is therefore limited somewhat to such uses as a wrapping paper with one glazed side and a tissue paper.

Yet another drying technique proposed is based on not supplying air to the closed hood but recycling the saturated steam produced by vaporized moisture as a part of the heat supplied to drier cylinders, which are pressurized vessels. However, in practice, it is difficult to eliminate air completely from the closed hood, and furthermore, volumes of air enter into the closed hood by the continuous feed of wet paper web and endless fabric belt. Another problem of air entry into the hood occurs when the paper inside the hood breaks due to shrinkage, and it is necessary to open the closed hood. After the interior of the hood has been cleared of the breakage, the hood is closed and is re-started. Under these circumstances, it is impossible to keep air entering into the hood below 4% as is generally recommended. Further, the saturated steam inside the hood becomes condensed when cooled by the wet paper load as well as external air entering the hood. Then, condensation occurs on the metal surfaces of the hood and dryer frames, and the condensates may drip onto the dried paper creating staining defects and low yield. Because of such inherent problems, this proposed technique has not been commercialized yet.

In view of such problems in the existing techniques of paper drying, the present inventor made a detailed study of the current process of paper drying, and a summary review of the current problems is presented in the following.

The current effort to dry a wet paper web on a production scale is generally based on causing the wet paper web to pass on dryer cylinders in series, while letting both sides of the wet paper web alternately come into contact with the dryer cylinders so as to produce smooth surfaces on both sides of the paper to avoid curling or cockling. Furthermore, dimensional stability is provided by interposing the wet paper web between the cylinder and the endless fabric belt so as to restrict the free shrinkage of the wet paper web. However, inasmuch as most of the drying action is performed during a free running zone between the adjacent dryer cylinders, where the paper web shrinkage is not restrained, such attempt is not sufficient.

Furthermore, with increasing production speed of the paper-making machine, the number of dryer cylinders has also been increased nearly to several tens to one hundred cylinders. However, with an increasing number of dryer cylinders, operational and maintenance problems have also increased. For example, sectional drive system is implemented to impart uniform tension to the paper web to cope with the shrinkage in the passing direction. Furthermore, suction canvass rolls, air boxes as well as endless fabric belts are employed to prevent paper breakage and achieve evenness of drying in both longitudinal and transverse directions. Nevertheless, breakage of paper does occur frequently between the dryer cylinders or dryer sections, and when the paper web is broken, the paper-making machine must be stopped, and the closed hood must be opened to remove the breakage before the machine can be re-started. The existing process therefore demands much attention and manpower, and the maintenance problems can present problems of personal safety in some cases.

The increased size of the dryer cylinders presents performance problems also. The dryer cylinders have reached a diameter size of 1.2 to 1.5 m and even 2 m, and the cylinder width has also been increased to a size in excess of 10 m. The steam pressure in the dryer cylinders, which are formed of castings, has reached 2–4 kg/m$^2$G. With increasing productivity demanded of the dryer cylinders, problems have emerged that it is difficult to collect the condensate inside the dryer cylinder because the condensate rotates with the interior surface of the dryer cylinder (rimming condition) due to centrifugal force by the increased rotational speeds. With high speeds of operation, draining of the condensates does not take place smoothly, which presents a problem of uneven condensate layer resulting in uneven moisture across the paper width.

Another serious problem is associated with the consumption of energy needed to produce a huge volume of steam required for the drying operation. Depending on the product, 1.5–3 tons of steam is required for every ton of dried paper produced. The performance of the hood has been improved in recent years by improving the insulation of the hood so as to obtain a dew point of around 65° C., and the volume of air required has also been lowered significantly. However, most of the steam vapor evaporated is still exhausted to the atmosphere, and a problem remains of generation of white smoke produced by condensation of moisture in the exhausted moist air, particularly during winter and early spring seasons. In some locations, this presents a serious hazard to residents and traffic.

A further important problem associated with the conventional drying process is the dew point of the carrier gaseous stream. So long as moist air is used as the carrier stream for the vaporized steam, the upper limit of dew point is around 65°–70° C. When the volume of dry air is low relative to the volume of the vaporized steam to be carried, saturation of the carrier air can occur easily, and condensates are produced inside the closed hood. The condensates dripping on the dried paper will produce rejects, and poor yield will be the result.

Another processing problem related to the method of drying is inherent in the conventional drying system. Specifically, the temperature of the side of the wet paper web in contact with the dryer cylinder reaches about near 100° C., but the side contacting the fabric belt can only reach a temperature of about 90° C., because the fabric belt is wetted with the moisture removed from the paper evaporated by the cylinder. Furthermore, because the fabric interior is wetted with moisture, there is a high temperature gradient between the outside layer of the fabric in equilibrium with moist air (65°–70° C.) and the inside layer in contact with the paper web (about 85° C.), thus greatly impeding rapid evaporation of water from the paper web. For this reason, there is little drying taking place in the zone of the dryer where the wet paper web is in contact with the fabric, and most of the drying actually takes place in the free running zone between the dryer cylinders, where the moisture is evaporated directly from the heated paper web. It is, indeed, estimated that about 80% of the moisture is evaporated in the free running zone and only about 20% of drying takes place in the fabric-restrained zone of the dryer. Therefore, the effort to improve the dimension stability of the paper to prevent shrinkage by providing the fabric-restrained zone appears to be largely wasted.

SUMMARY OF THE INVENTION

The present invention presents a process and apparatus to overcome the problems described above by achieving high rate of moisture removal from wet sheet material resulting in a highly efficient and energy saving drying process.

According to a first aspect of the present invention, there is provided a process for drying a wet sheet material comprising the steps of:

(a) introducing a drying medium into a closed chamber surrounding a plurality of heated dryer cylinders in series and a gas permeable fabric belt to produce a drying atmosphere in the closed chamber, the drying medium being selected from the group consisting of a superheated steam of no less than 100° C. and a heated moist air of dew point of no less than 80° C.;

(b) admitting the wet sheet material into the closed chamber;

(c) causing the wet sheet material to travel in the drying atmosphere in the closed chamber while restraining the sheet material from both sides thereof by means of the dryer cylinders and the fabric belt, to thereby effect a restrained drying to evaporate moisture of the sheet material from a curved continuous evaporating surface to dry the sheet material;

(d) removing the steam evaporated from the wet sheet material through the gas permeable fabric belt to recirculate the steam for reuse; and (e) exiting the dried sheet material from the closed chamber.

In the foregoing, the removing step (d) may include recirculating the evaporated steam at least partly to the dryer cylinders to heat the same, or may include heating a part of the recirculated steam to blow against the wet sheet material restrained by the dryer cylinders and the fabric belt. The traveling step (c) may include blowing the drying medium against the wet sheet material restrained by the dryer cylinders and the fabric belt at a high impingement speed. In the traveling step (c), the curved continuous evaporating surface is defined by a plurality of horseshoe-shaped surfaces connected to one another when viewed axially of the dryer cylinders. Furthermore, the traveling step (c) may include passing the wet sheet material over the heated dryer cylinders in series with one side thereof being held in contact with an outer peripheral surface of each dryer cylinder and with the other side thereof being pressed by the fabric belt; or may include passing the wet sheet material between adjacent dryer cylinders using suction fabric rolls, in such a manner that the sheet material passes On the suction fabric roll through the gas permeable fabric belt interposed therebetween; and the removing step (d) may include sucking the steam evaporated from the wet sheet material through the suction fabric rolls. In addition, the traveling step (c) may include passing the wet sheet material between adjacent dryer cylinders in such a manner that the sheet material is restrained on the gas permeable fabric belt by suction force. In more detail, the traveling step (c) may include restraining the wet sheet material, released from one dryer cylinder, on one gas permeable fabric belt passing over the one dryer cylinder; subsequently sandwiching the wet sheet material between the one gas permeable fabric belt and another gas permeable fabric belt passing over the other dryer cylinder; and subsequently keeping the wet sheet material restrained on the above-mentioned another gas permeable fabric belt. The removing step (d) may include sucking the steam evaporated from the wet sheet material through the gas permeable fabric belt. Moreover, the traveling step (c) may include passing the wet sheet material over the heated dryer cylinders in series while sandwiching the sheet material between a pair of the gas permeable fabric belts. In addition, the traveling step (c) may include blowing the drying medium against the wet sheet material sandwiched between the gas permeable fabric belts, and the removing step (d) may include sucking the steam evaporated from the wet sheet material through the gas permeable fabric belts.

Furthermore, when the drying medium is the heated moist air, it is preferable that the moist air have a dew point close to 100° C. at a contacting interface between the outer peripheral surface of the dryer cylinder and the sheet material, and at least 80° C. at a position where the sheet material is spaced apart from the dryer cylinder. The heated moist air may preferably be of a dry bulb temperature of at least 150° C. containing at least about 50% by volume of superheated steam.

According to a second aspect of the present invention, there is provided an apparatus for drying a wet sheet material comprising:

a dryer frame assembly;

bearing devices mounted on the dryer frame assembly;

a plurality of dryer cylinders for heating the sheet material, each of the dryer cylinders including a cylinder body having an outer peripheral surface and opposite end faces thereof and a pair of shaft portions formed at the opposite end faces, each dryer cylinder being rotatably arranged on the dryer frame assembly with the shaft portions being supported by the bearing devices;

an endless gas-permeable fabric belt associated with the dryer cylinders and arranged to cooperate with the dryer cylinders to transfer the sheet material, the fabric belt being looped around a respective dryer cylinder to press the sheet material towards the outer peripheral surface of the dryer cylinder to restrain the sheet material;

a transferring device associated with the dryer cylinders for transferring the sheet material from a respective dryer cylinder to the dryer cylinder adjacent thereto while keeping the sheet material restrained;

a heat-insulated hood assembly arranged adjacent to the dryer cylinders so as to substantially surround the outer peripheral surfaces of the dryer cylinders, with the bearing devices being located outside, to define a narrow sealed dryer chamber, the heat-insulating hood assembly being at least partly movable between a closed position where the dryer chamber is substantially closed and an opened position where the dryer chamber is opened; and a drying medium-circulating device attached to the heat-insulated hood assembly for supplying thereinto a drying medium to produce a drying atmosphere in the dryer chamber and for removing the steam evaporated from the sheet material through the gas permeable fabric belt to recover the steam for reuse, the drying medium being selected from the group consisting of a superheated steam of no less than 100° C. and a heated moist air of dew point of no less than 80° C.

In the foregoing, the dryer cylinders may be disposed in a double row arrangement including an upper row of dryer cylinders and a lower row of dryer cylinders, or may be disposed in a single row arrangement including a single row of dryer cylinders. The heat-insulated hood assembly may include an upper hood, a lower hood and a middle hood interposed between the upper hood and the lower hood, at least one of the upper hood, the lower hood and the middle hood being movable between the open position and the closed position. Furthermore, there may be provided a pair of elevating devices each attached to a respective one of the upper hood and the lower hood, for moving the respective hood towards and away from the dryer cylinders. The transferring device may include a plurality of suction fabric rolls each disposed adjacent to a respective associated one of the dryer cylinders for guiding the sheet material onto or away from the associated dryer cylinder. A pair of the endless gas-permeable fabric belts may be provided, one of the endless gas-permeable fabric belts being looped around an associated one of the dryer cylinders while the other endless gas-permeable fabric belt is looped around the dryer cylinder disposed adjacent to the associated dryer cylinder, the pair of fabric belts substantially extending to an intermediate position between the one dryer cylinder and the other dryer, whereby the pair of fabric belts serve as the transferring device. Furthermore, a pair of the endless gas-permeable fabric belts may be provided to sandwich the sheet material therebetween, the pair of fabric belts being looped around a respective dryer cylinder and extending from a respective dryer cylinder to the dryer cylinder adjacent thereto, whereby the pair of fabric belts serve as the transferring device. The drying medium-circulating device may include a suction device having a plurality of suction ports arranged along the path of the sheet material for sucking the steam evaporated from the sheet material. The drying medium-circulating device may further include a blower device having a plurality of blower outlets arranged along a path of the sheet material for blowing out the drying medium against the sheet material. Furthermore, the drying medium-circulating device may further include a plurality of circulating conduits connected to the suction device for reuse of the recovered steam. The circulating conduits are connected to the blower device, or are further connected to the dryer cylinders to heat the same.

Moreover, there may be provided an entrance sealing device attached to the heat-insulated hood assembly for admitting the sheet material into the hood assembly in sealing relation thereto, as well as an exit sealing device attached to the hood assembly for exiting the sheet material from the hood assembly in sealing relation thereto. Each of the entrance sealing device and the exit sealing device may include at least two sealing rolls disposed inside and outside the hood assembly, respectively; and a sealing blanket looped around the at least two sealing rolls so as to pass through the hood assembly; a feeding roll disposed in association with one of the sealing rolls to guide the sheet material therebetween; and a sealing member disposed between the feeding roll and the hood assembly and having a pair of convexly arcuate portions held in resilient contact with the feeding roll and the sealing roll associated therewith. The sealing device may further comprise a pair of opposite sealing plates attached to the hood assembly so as to be held in sealing contact with opposite ends of the feeding roll and the sealing roll associated therewith.

Moreover, the drying apparatus may further comprise a plurality of gas supply boxes disposed adjacent to the suction fabric rolls, each gas supply box including a surface facing a part of an outer peripheral surface of a respective suction fabric roll and having a plurality of blower ports formed in the surface for blowing the drying medium towards the respective suction fabric roll. A pair of the suction fabric rolls may be preferably disposed adjacent to a respective dryer cylinder, and the gas supply box is disposed between the pair of suction fabric rolls with the blower ports being directed towards both of the pair of suction fabric rolls. The drying apparatus may further comprise a plurality of blower and suction devices disposed adjacent to a respective suction fabric roll, each of the blower and suction devices including a plurality of gas-blower ports for blowing the drying medium towards the respective suction fabric roll and a plurality of suction ports for sucking the steam evaporated from the sheet material passing on the respective suction fabric roll.

Additionally, the dryer frame assembly, which includes a front dryer frame disposed at an operational side of the drying apparatus, may be modified so that the front dryer frame includes a lower frame portion for supporting the lower row of dryer cylinders, an upper frame portion disposed above the lower frame portion for supporting the upper row of dryer cylinders, and an intermediate portion connecting the lower frame portion and the upper frame portion and being shifted from the upper and lower frame portions in a direction away from the cylinders.

With the above procedures and construction, the drying process and apparatus of the invention achieves very effective restrained drying using a drying medium as mentioned above. FIG. 1 depicts temperature distribution occurring when superheated steam in excess of 100° C. is used to dry a paper web in comparison with that of the conventional paper drying process, whereas FIG. 2 shows the same diagrammatical representation when employing an atmosphere of a prescribed heated moist air.

Referring first to FIG. 1, the results of measurements of the contact interface temperatures of the paper web are shown in broken lines by $S'_1$ designating the temperature on the fabric side, $S'_2$ designating the temperature on the cylinder side, respectively. The fabric temperatures are designated by, $F'_1$, $F'_2$ and $F'_3$, at the paper side, in the middle and at the outside of the endless fabric belt. It can be seen that although there is temperature difference of about 5° C. from about 110° C. to about 105° C., the atmosphere is of superheated steam exceeding 105° C. throughout the entire range of drying. The results indicate therefore that the paper web is subjected to high temperatures while being tightly pressed against the dryer cylinder by the high tension force of the endless fabric belt. The pressure at the vaporization surface reaches 1.47 atm which is close to saturation vapor pressure at 110° C., and it can be understood that drying proceeds rapidly under such operating conditions.

In contrast, in the conventional processing conditions shown in the bottom portion of FIG. 1, there are large variations in the temperatures of the paper web as well as in the temperatures of the fabric belt. The temperature designations are as before, and the results indicated in solid lines show that there is a large temperature variation, 50–100° C., while the paper web travels from Zone 1 to Zone 4. During Zone 1, which is the stage before the intimate contact occurs between the paper web and the dryer cylinder 1, only pre-heating of the paper web takes place, and there will be no vaporization of the moist occurring from the paper web. In Zone 2, when the fabric belt covers over the paper web, gradual vaporization of the moisture occurs from the paper web. However, when the atmosphere in the closed hood is that of the due point of about 60°–70° C., the vaporized moisture is cooled down and condensed in the paper web. After going through many such cycles of evaporation and condensation, the evaporated moisture reaching the fabric belt will be condensed again in the belt. When the paper web reaches Zone 4, free running stage, vaporization of the moisture to the surrounding environment will cause the temperature of the paper web to drop due to the release of the latent heat of vaporization. The paper web returns to Zone 1 to repeat the slow process of drying described above, and the overall effect is that the discontinuous drying process occurring in the conventional dryer will be lengthy and costly in terms of the wasted energy and effort.

There are other problems introduced by the type of drying process taking place in the conventional dryer. For example, in the free running Zone 4, the paper web freely undergoes cross-direction shrinkage, and results in the final paper product having poor printing properties because of poor dimension stability of the paper, curling and cockling or wrinkles. Unlike plastic film, paper sheet is composed of many wood fibers fibrilized into a three dimensional network during drying, and the network consists of dense regions and non-dense regions. In the process of drying in a moisture laden air, different rates of evaporation prevails, because the non-dense regions dry quickly to approach zero absolute moisture content while the dense regions tend to retain the moisture longer. The result is a paper product having cockling or stiffness typical of western type of papers. In the process of the present invention, in which the drying medium is steam, an amount of moisture corresponding to that in the steam remains in the fiber network, and it is possible to manufacture relatively thick papers having a Japanese hand-made paper feel.

Also, it is noted that in the present process, there are no stages to correspond with Zones 1 and 3 in the conventional drying process. Almost all the drying occurs while the paper web is being held tightly by the fabric belt against the dryer cylinder as in Zone 2. It is only during the period between the cylinders, leaving one cylinder to reach another cylinder, that the paper web leaves the surface of the dryer cylinder 1. However, the paper web is kept restrained by the fabric belt or the like even during this period, and drying takes place in an atmosphere of superheated steam in excess of 100° C. Therefore, there is effective drying throughout the process. Furthermore, because of the restraints imposed on the paper web at all times in the process of the present invention, high dimensional stability (small shrinkage and elongation due to atmospheric conditions) can be obtained, and the resulting paper products are highly suitable for printing applications because they are not susceptible to curling or cockling.

Another feature is that there is no free running Stage 4 in the process of the present invention, and the sheet material is constantly being held by the processing devices, and even if the sheet material is broken, the sheet material can be carried forth through the exit of the closed hood.

Still another feature is that it is possible to quickly vaporize a large amount of moisture to dry the sheet material in a super-heated steam atmosphere in excess of 105° C., because super-heated steam (in excess of about 110° C.) is directed to the sheet material 35 at a high speed through the blast ports 19 and the porous fabric belt 36. This arrangement permits delivery of a large amount of heat rapidly to the sheet material 35 by condensing the super-heated steam in the sheet material 35 to release the latent heat of condensation in the sheet material 35, thereby aiding the process of vaporization.

In contrary, in the conventional process of moist air, the amount of heat transmitted per unit volume of moist air is only 1/10 of the super-heated steam due to low value of latent heat, even if wet web is heated by heated moist air up to 450° C., only the sensible heat of moist air was used for drying. If the sheet material is heated by such a high temperature, there is even a danger of ignition of the sheet material.

Furthermore, softening points (temperature) of lignin and hemicellulose reduce when they contain water. Specifically, the softening point of dried lignin is 134° to 250° C., whereas that of water saturated lignin is 72° C. Therefore, flexibility of fibres is increased, and dried sheet strength is substantially increased due to the covalent bonding (ether linkage, ester linkage) of the hydroxyl group in cellulose with other substances contained in the wood.

As mentioned previously, the drying atmosphere may be that of a heated moist air of dew point of no less than 80° C., preferably a moist air having a dew point of close to 100° C. at a contacting interface between the outer peripheral surface of the dryer cylinder and the sheet material, and at least 80° C. at a position where the sheet material is spaced apart from the dryer cylinder. In addition, it is preferable that the moist air containing no less than 50% by volume of superheated steam of a temperature of at least about 110° C., preferably of no less than 150° C., be employed for the impingement drying. FIG. 2 depicts a temperature distribution when drying is effected under such conditions.

Referring to FIG. 2, the results of measurements of the contact interface temperatures of the paper web are shown in dotted-and-dashed lines by $S''_1$ designating the temperature on the fabric side, $S''_2$ designating the temperature on the cylinder side, respectively. The fabric temperatures are designated by, $F''_1$, $F''_2$ and $F''_3$, at the paper side, in the middle and at the outside of the endless fabric belt. It can be seen that although there is temperature difference of about 2° C. from about 101° C. to about 103° C., the atmosphere is of at least 50% by volume of superheated steam exceeding 100° C. The results indicate therefore that the paper web is subjected to high temperatures while being tightly pressed against the dryer cylinder by the high tension force of the endless fabric belt. The pressure at the vaporization surface reaches 1.47 atm which is close to saturation steam pressure at 110° C., and it can be understood that drying proceeds rapidly under such operating conditions.

As will be seen from FIG. 2, there is a temperature difference of about 16° C. from 85° C. to 87° C. in Zone 1" in which the paper web begins to contact the dryer cylinder and the fabric belt. In addition, in Zone 3" in which the blowing of the heated gas is completed, the temperature ranges from 101° C. to 103° C., resulting in the same temperature difference of 16° C. Furthermore, in Zone 4", in which the heated gas is blown against the paper web while keeping the paper web restrained by fabric, it is preferable that high temperature gas of no less than 150° C. is blown against the both sides of the wet paper web while sucking the steam evaporated from the paper web. With these operations, the drying of the paper web at the pocket portions between the dryer cylinders can be facilitated while keeping the dry-bulb temperature of at least 90° C. in the atmosphere with a dew point of 85° C.

In FIG. 2, the temperature-distribution for the conventional drying process is also presented and is shown in solid lines. The problems relevant to the conventional process are similar to those mentioned in conjunction with FIG. 1. Therefore, it is clear that the present process is superior to that of the conventional process even when a prescribed heated moist air is employed as the drying medium. This is particularly the case when the moist heated air of dew point of at least 80° C. contains no less than 50% by volume of superheated steam (i.e., absolute humidity 1.00 kg steam/kg dried air).

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 3:
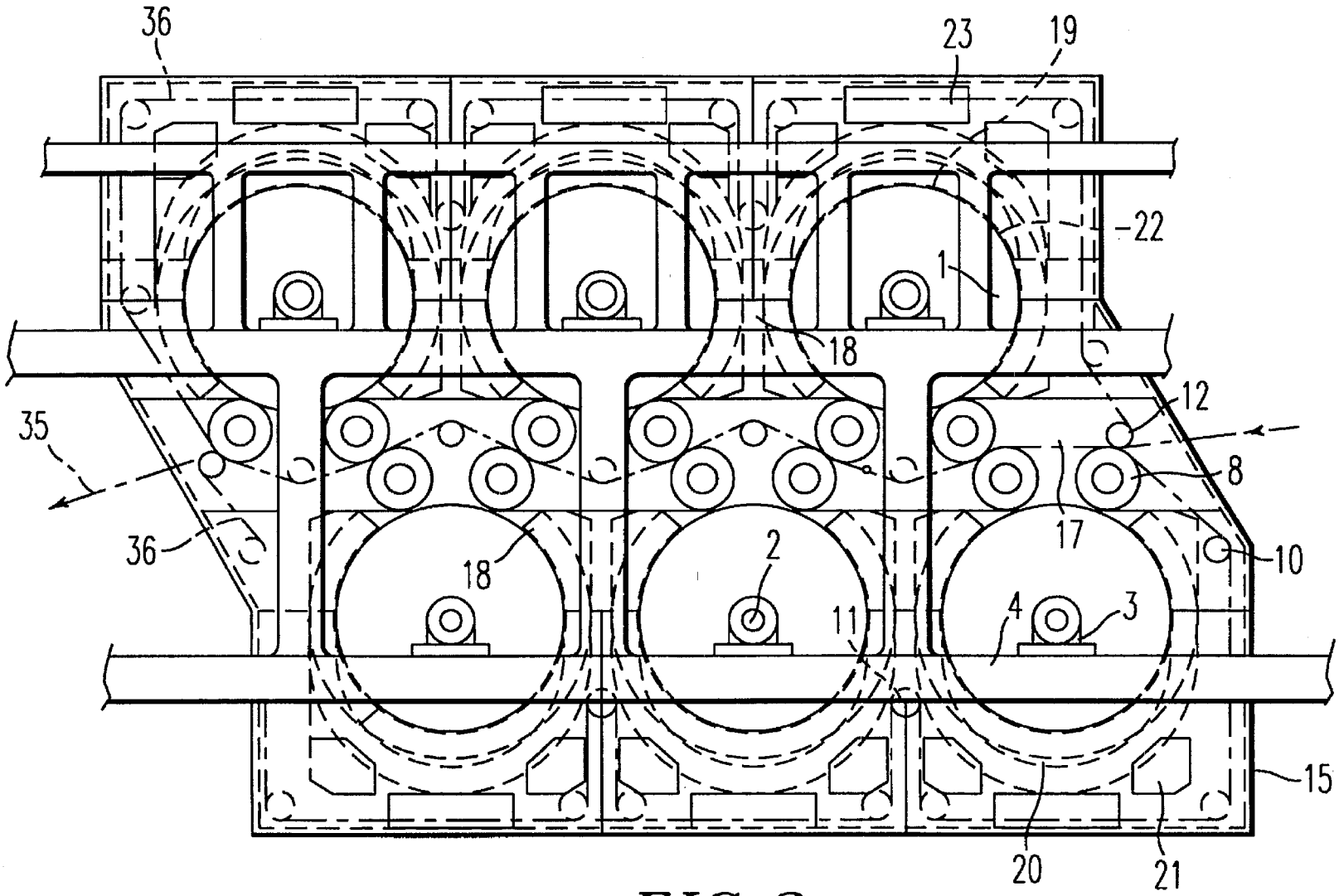
FIG. 3 is a side elevational view of a drying apparatus in accordance with a first embodiment of the present invention.

A drying apparatus in accordance with a first embodiment of the present invention, which is suitably adapted to perform the drying process of the invention, will be first explained with reference to FIGS. 3 to 5.

Figure 4:
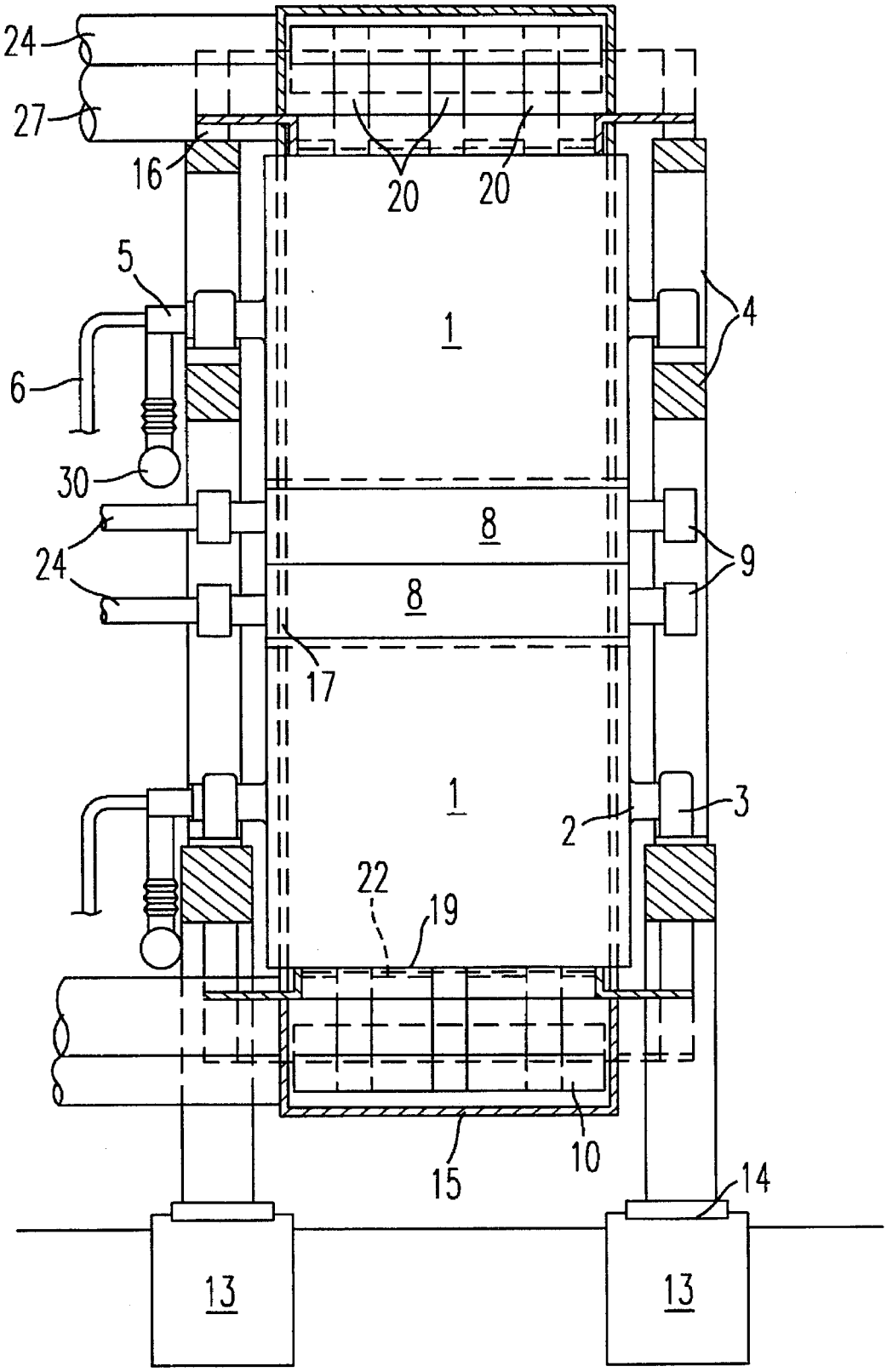
FIG. 4 is a transverse cross sectional view of the drying apparatus of FIG. 3.
Figure 5:
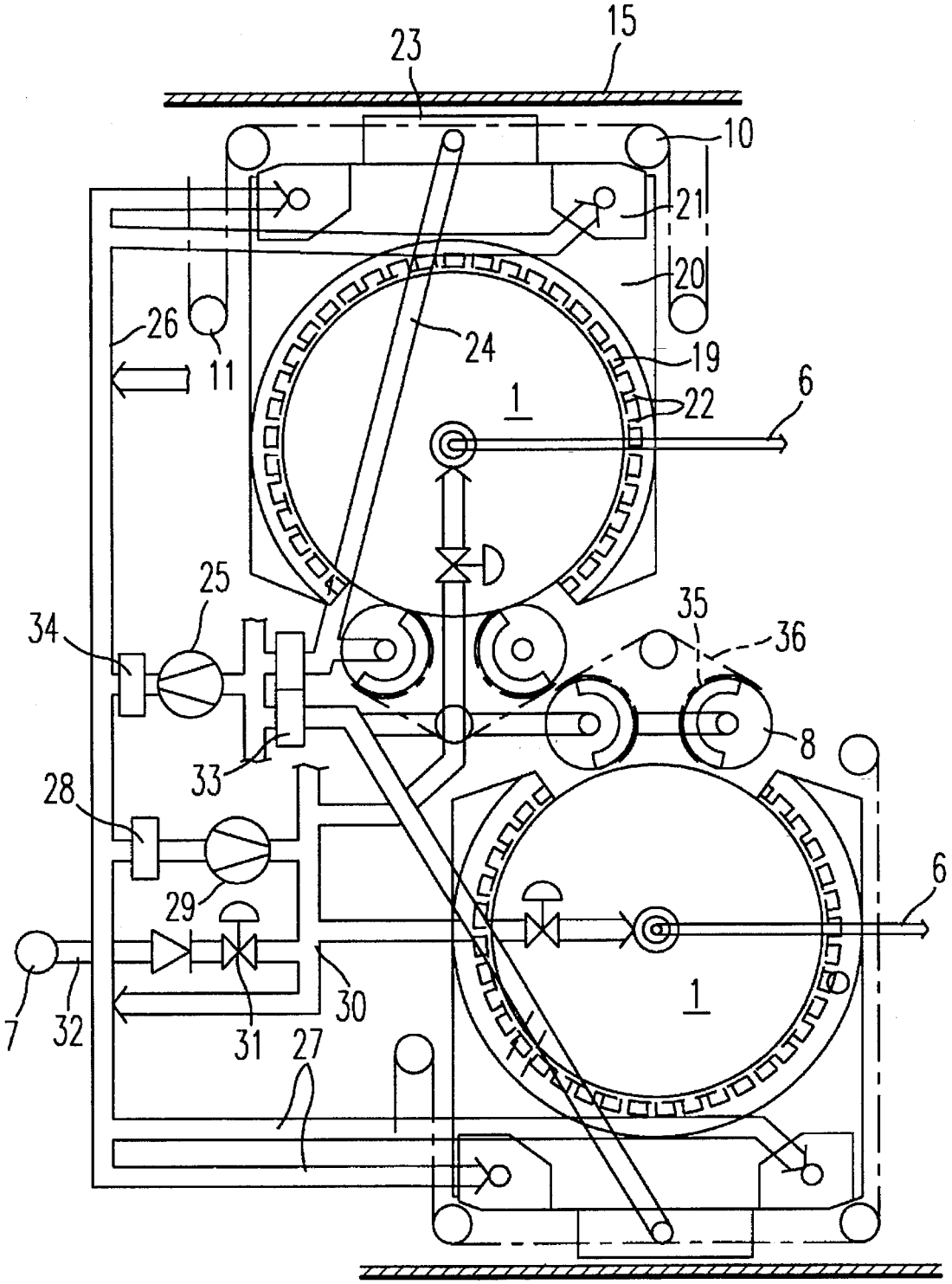
FIG. 5 is a schematic representation showing the flow of the stream circulated in the drying apparatuses of the invention.

As can be seen from FIG. 4, the drying apparatus includes dryer frames 4 which are supported on foundations 13 via sole plates 14 anchored thereto. A plural groups of dryer cylinders 1, each of which includes a cylinder body having a pair of cylinder shafts or journals 2 formed at opposite ends thereof, are installed on the dryer frames 4 with the shafts 2 being rotatably supported thereon through suitable bearing devices 3.

When a double row multi-cylinder arrangement is adopted, the installation area can be minimized by staggering each group of cylinders into an upper row of cylinders and a lower row of cylinders. For a single row multi-cylinder arrangement, respective groups of cylinders should be placed such that the web entrances/exits of respective groups are directed alternatively upwards or downwards to prevent curling of the paper web. Or, if a vertical setup is used, cylinders may be arranged such that a half of cylinders rotate to the left while the remaining half to the right. The two types of arrangement can also be mixed to suit the requirements of the drying facility designed. Disposed adjacent to each dryer cylinder 1 are a pair of suction fabric rolls 8 which are installed on the dryer frames 4 through suitable fabric roll bearings 9.

Furthermore, in association with each group of cylinders 1, upper canopy hoods 15 made of a conventional insulating panelling material are provided so as to cover those portions of the dryer cylinders 1 in the upper row which are positioned above the plane including the axes of the shafts 2 of the upper row cylinders 1, whereas lower canopy hoods 15 also made of the same insulating panelling material are provided so as to cover those portions of the dryer cylinders 1 in the lower row which are situated below the plane including the axes of the shafts 2 of the lower row cylinders 1. Each canopy hood 15 is attached to the dryer frames 4 for vertical movement, and an elevating device, comprised of one or more drive cylinder units mounted on the dryer frames 4 are operably connected to a respective canopy hood 15 to raise or lower the same. As is the case with a conventional dryer cylinder, each of the dryer cylinders 1 is provided at a driving side thereof with a rotary joint 5 having a vapor injection port and a condensate drain port, and the vapor injection port is connected to a pressurized steam pipe 30, whereas the drain port is connected to a drain pipe 6.

Disposed between the upper and lower canopy hoods 15 are a middle hood 17 made of a similar insulation panelling material and an opening device 18 comprised of an openable door attached to the middle hood 17 for accessing the interior of the middle hood for inspection/cleaning purposes. Thus, the upper and lower canopy hoods 15 and the middle hood 17 are arranged so as to cooperate with one another to define a closed drying chamber therein with the exception of the entry and exit openings formed through the middle hood 17 for entering/exiting of the paper web 35 (sheet material).

Inside the hoods, there are provided a plurality of drying medium-supply boxes 20 of an annular shape associated with a respective dryer cylinder 1 so as to substantially surround the outer peripheral surface thereof, these supply boxes 20 being spaced axially of the dryer cylinder 1. Provided in association with the supply boxes 20 are a blast unit comprised of a plurality of elongated tubular members of a rectangular-shaped cross-section arranged around the cylinder 1 in circumferentially spaced relation, and each having a great number of blast or blower ports 19 formed in the surface opposed to the dryer cylinder 1. Furthermore, there are provided suction units, each of which comprises a plurality of elongated suction ports 22 defined by the spacings between adjacent blast ports 19. The blast ports 19 and the suction ports 22 may be of either slit or circle shape, and it is preferable that the spacing between the blast ports and the cylinder be about 10~25 mm. The blast units and the suction units are connected separately to the suitable canopy hoods 15 and middle hood 17.

Furthermore, a plurality of connecting ducts 21 are connected to the supply boxes 20, and are connected at the driving side of the dryer to drying medium-supply ducts 27 through suitable flexible joints. The interfaces where the dryer cylinders 1 and the suction fabric rolls 8 come into contact with the canopy hoods 15 and the middle hood 17 are made as a labyrinth structure so as to prevent the outside air from entering the closed hood or to prevent a large volume of the vaporized steam from escaping to the outside.

A variation of the first embodiment is to have fixed canopy hoods 15 and the drying medium-supply boxes 20, the blast ports 19 and the suction ports 22 are provided on base frames which are disposed inside the hoods so as to be adjacent to the operational and drive sides of the dryer. Suitable bridging frame members are secured to the base frames so as to extend out through the hoods, so that the bridging frame members can be moved up and down from outside the closed hood by the elevating devices 16 mounted on the dryer frames 4.

Another method would be to place the elevating devices 16 on both inside ends of the fixed canopy hoods 15, and raise or lower the bridging frames. Door devices for the inspection ports are provided on both sides of the canopy hoods 15.

Fabric rolls 10 are provided on the corners of the hoods, and pinch fabric rolls 12 are provided at the entrance/exit of the hoods covering each group of dryer cylinders 1. Fabric tension rolls 11 are also provided at suitable locations so that upper and lower gas-permeable endless fabric belts 36 can travel inside the sealed hoods. A suction box 23, to which the suction unit is connected, is disposed adjacent the supply box at a position generally diametrically opposite to the fabric suction rolls 8 with respect to a respective cylinder 1, and is connected at the driving side to a suction duct 24 through a flexible joint.

The steam circulation circuit is completed by providing, preferably on the driving side of the dryer cylinder group, exhaust emission screens 33 for removing mist, paper dust and other foreign matters in the exhaust gas; an exhaust gas heater 34 heated by suitable fuel or thermal medium; a steam circulation fan 25; an adiabatic expansion nozzle 26; supply ducts 27; a steam scrubber 28; a steam compressor 29; pressurized steam pipes 30; a steam adjusting valve 31; a make-up steam pipe 32, and suitably connecting them to suction duct 24, connecting duct 21 and the steam header pipe 7.

A wet paper web 35 having 50–60% of moisture which is obtained by passing wire and press parts is fed into the upper and lower pinch fabric rolls 12 at the entrance to the closed hood sealed with insulation panels. The paper web 35 is then sandwiched between the upper and lower endless fabric belts 36 travelling inside the closed hood to reach the first lower dryer cylinder 1 located at the entrance of the hood. The paper web 35 is then pulled downwards by the suction action of the suction fabric roll 8, and passes on the dryer cylinder 1 with the top surface being held in intimate contact with the outer peripheral surface of the cylinder 1. The bottom surface of the paper web 35 is strongly pressed by the endless fabric belt 36 which is tensed by the fabric tension rolls 11. Thus, the paper web 35 is dried while restrained by the cylinder 1 and the fabric belt 36. When the paper web 35 passes over the first dryer cylinder 1, the paper web 35 is released from the first dryer cylinder 1 at the exit by being pulled by the second suction fabric roll 8. The paper web 35 is again sandwiched between the two endless fabric belts 36, and reaches the entrance to the second dryer cylinder 1 disposed in the upper row, and the drying process is repeated over again as described above.

In the above process, by providing control valves independently on the respective suction fabric rolls 8, and selectively adjusting the control valves, the paper web 35 can be selectively passed through either the upper row of dryer cylinders or the lower row of dryer cylinders 1, thereby enabling to control the difference in the degree of curl or flatness of the front surface and the back surface of the paper web 35.

After the paper web 35 passes through the last dryer cylinder 1, it is transported to the outside the dryer hood through the exit opening by being clamped by the pinch fabric roll 12.

In the meantime, the steam evaporated from the wet paper web 35 takes the following path. The steam is sucked in through the suction ports 22 and the suction fabric rolls 8 to reach the emission screen 33 via the suction ports 23 and the suction ducts 24 of the canopy hoods 15. After the foreign particles such as paper dust are removed by the emission screen 33, the steam pressure is increased by the steam circulation fan 25. The steam is then heated at the exit by the superheated steam from the adiabatic expansion nozzle 26, and most of this steam is directed to the paper web 35 after passing through the ducts 27, the supply boxes 20, the blast ports 19 and through the endless fabric belts 36. The blasting or impinging action drives out the stagnant moisture from the voids within the endless fabric belts 36. This action not only heats the paper web 35 directly but also disturbs the boundary layer containing the saturated steam above the paper web 35 to promote evaporation of the moisture in the paper web 35, and produces an atmosphere of super-heated steam in excess of 100° C.

There is a limit to the heating capability of the adiabatic expansion nozzle 26, and therefore, when it is required to quicken the drying process by further heating the circulating steam, the exhaust heater 34 operated by fuel or thermal medium can be used to indirectly heat the steam. In this case, the adiabatic expansion nozzle 26 is closed.

A part of the steam pressurized by the circulation fan 25 is sent to the steam scrubber 28 to remove foreign particulate matters and non-condensable gases. The steam is then adiabatically compressed by means of the steam compressor 29 to increase temperature and pressure, and most of this steam is sent to the dryer cylinders 1 via the pressurized pipes 30 to heat the cylinders 1. A part of this steam is used to heat the recirculated steam via the adiabatic expansion nozzle 26. Furthermore, the make-up pipe 32 is used to compensate for a deficient amount of steam. The flow rates of the circulating steam are regulated by adjusting the steam valve 31 to control the moisture percent of the paper web 35 to control the curling of the paper web 35 or by adjusting the amount of steam supplied to the upper and lower dryer cylinders 1. In the foregoing, the elongated blast ports 19 may each be divided into a plurality of longitudinally separated zones so that the amount of steam blast differs from zone to zone, and it is thus possible to regulate the amount of steam blast in the width direction of the dryer cylinder 1, to thereby control the uniformity of moisture content in the paper web 35 in the width direction thereof.

Figure 6:
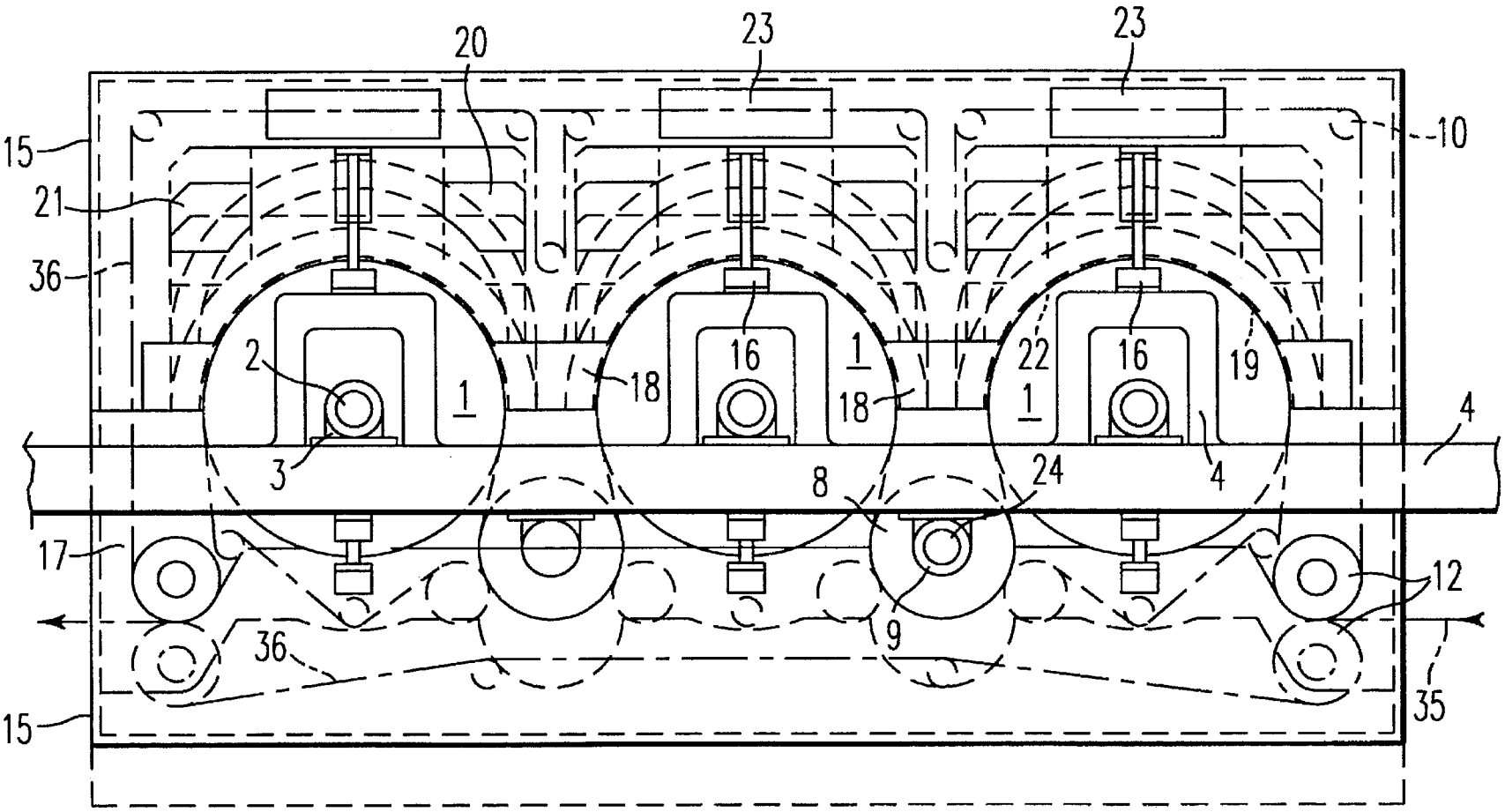
FIG. 6 is a side elevational view showing a drying apparatus in accordance with a second embodiment of the present invention.

FIG. 6 depicts a second embodiment of the drying apparatus in accordance with the invention, in which each group of dryer cylinders 1 are provided in a single row arrangement. In this embodiment, adjacent groups of dryer cylinders 1 are arranged such that the web entrance/exit direction of one group of cylinders 1 is alternately upwards or downwards from the other group of cylinders 1. For illustration purposes, FIG. 6 shows a group of dryer cylinders 1 with the entrance/exit facing downwards. Each dryer cylinder 1 is installed on the dryer frames 4 with the shafts 2 being rotatably supported thereon through the bearings 3. As seen from FIG. 6, a single suction fabric roll 8 is disposed at a position slightly lower than and between the adjacent two cylinders 1 with its journal portions being rotatably supported on the dryer frames 4 through the bearings 9. Furthermore, an upper canopy hood 15 is provided so as to cover those portions of the cylinders 1 which are positioned above the line including the axes of the shafts 2, whereas a lower-canopy hood 15 is provided below the upper canopy hood 15. These canopy hoods are constructed so that they can be raised or lowered by means of the elevating device 16 comprised of a plurality of drive cylinder devices. Between the upper and lower canopy hoods 15, there are provided a middle hood 17 and an opening device 18 comprised of a plurality of openable doors for accessing the middle hood interior for the purpose of inspection or cleaning. The hoods are sealed tightly during a drying operation except for the openings for entry and exit of the paper web 35.

Some points of difference from the first embodiment are that there are no drying cylinder 1 inside the lower canopy hood 15. A lower endless fabric 36 which is driven by fabric rolls 10 is only provided for feeding/discharging of the paper web 35. When the paper web or other sheet material to be dried is thick so that there is no danger of breakage thereof, the lower endless fabric 36 in the lower hood can be eliminated.

Figure 10:
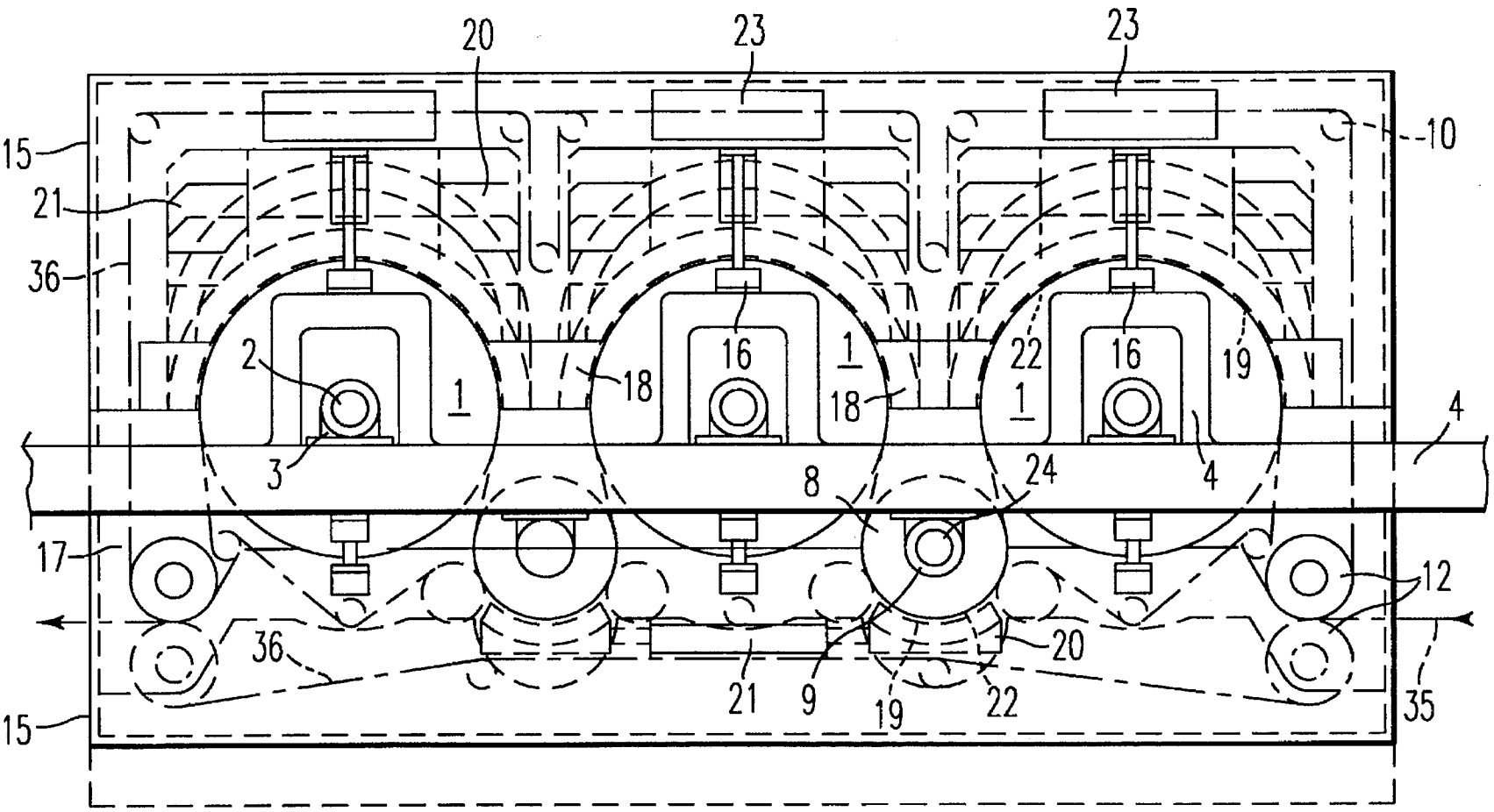
FIG. 10 is a side elevational view showing a modification of the apparatus of FIG. 6.

In the foregoing, as shown in FIG. 10, it is more preferable that a plurality of blower ports 19 as well as a plurality of suction ports 22 are arranged so as to surround the lower part of the outer peripheral surface of a respective suction fabric roll 8 with spacings of about 10 to 25 mm formed therebetween. The blower ports 19 are connected to the supply boxes 20 which are further connected to the connecting ducts 21. The steam to be sucked by the suction fabric roll 8 is of small quantity, and most of the steam is sucked through these suction ports 22.

In operation, the paper web 35 is dried in basically the same manner as in the first embodiment. More specifically, the paper web 35 is guided by a pair of top and bottom pinch rolls 12 at the entrance to the hoods and is held between the two endless fabric belts 36 so as to go around the inside of the closed hood. When the paper web 35 reaches the dryer cylinder 1, it passes over the cylinder 1 with the bottom surface being held in contact with the outer peripheral surface of the cylinder 1 and with the top surface being held tightly against the endless fabric belt 36 which is tensed by the action of the fabric tension rolls 11. When the paper web 35 passes over the first dryer cylinder 1, the paper web 35 is released from the cylinder 1 at the exit by being pulled by the suction fabric roll 8, and the paper web is further guided onto the second cylinder 1. After repetition of the above movement, the paper web 35 is led out of the hood by being pinched by the pinch fabric rolls 12 at the exit. The other operations performed are the same as those in the first embodiment, and thus their explanations will be omitted.

Figure 7:
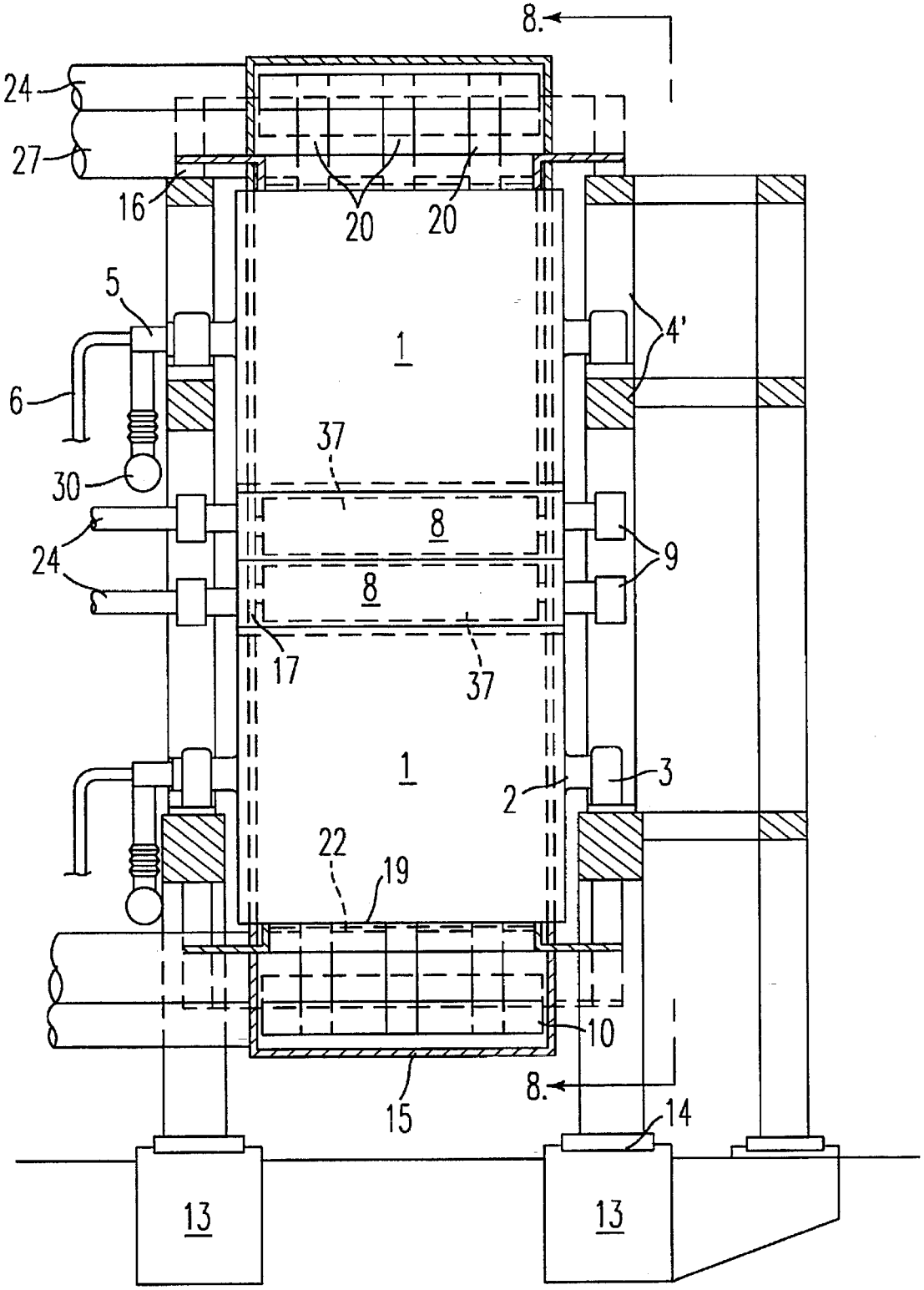
FIG. 7 is a transverse cross-sectional view of a drying apparatus in accordance with a third embodiment of the invention.
Figure 8:
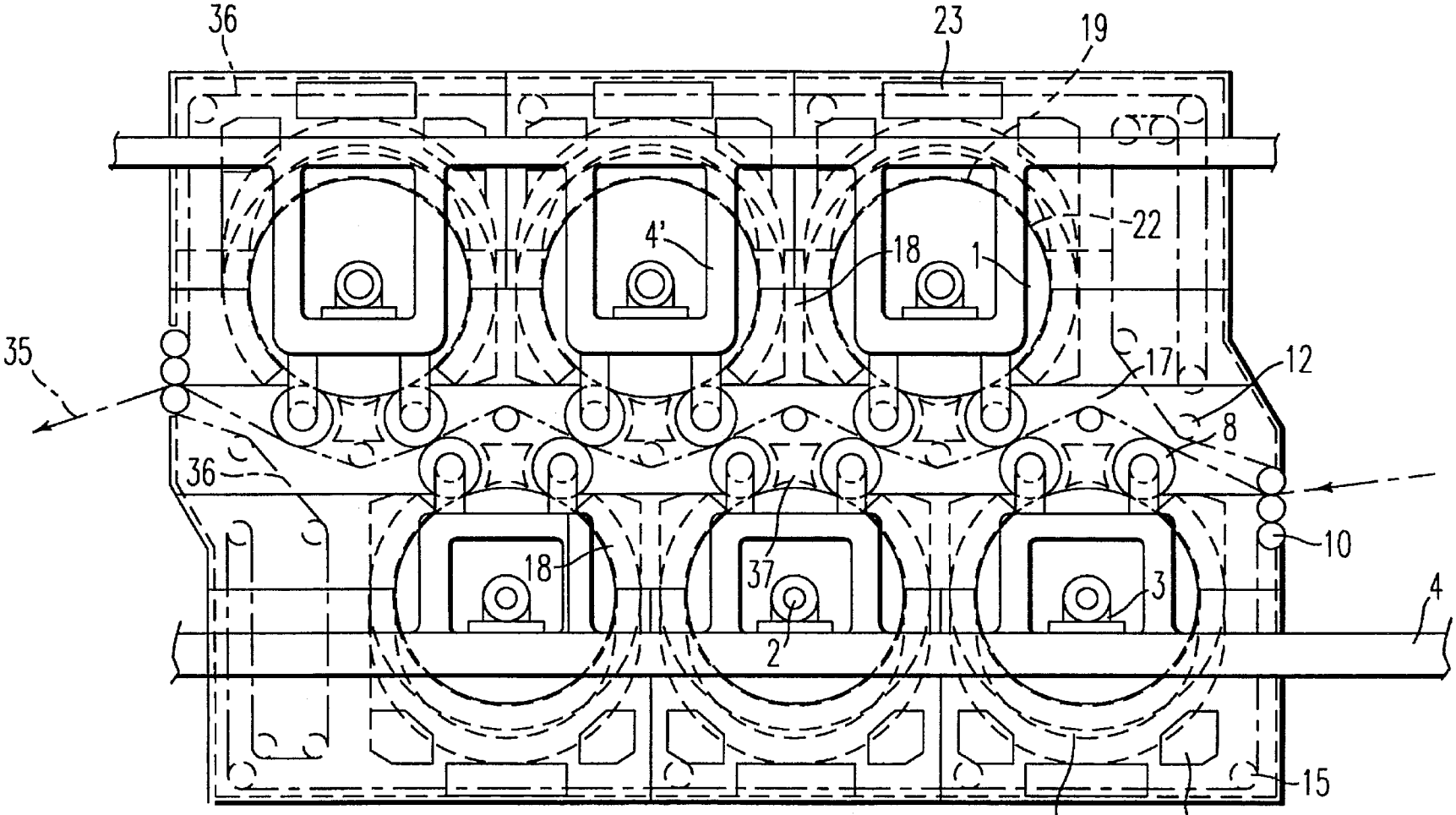
FIG. 8 is a side elevational view of the apparatus of FIG. 7 as seen in the direction of the lines VIII—VIII in FIG. 7.
Figure 9:
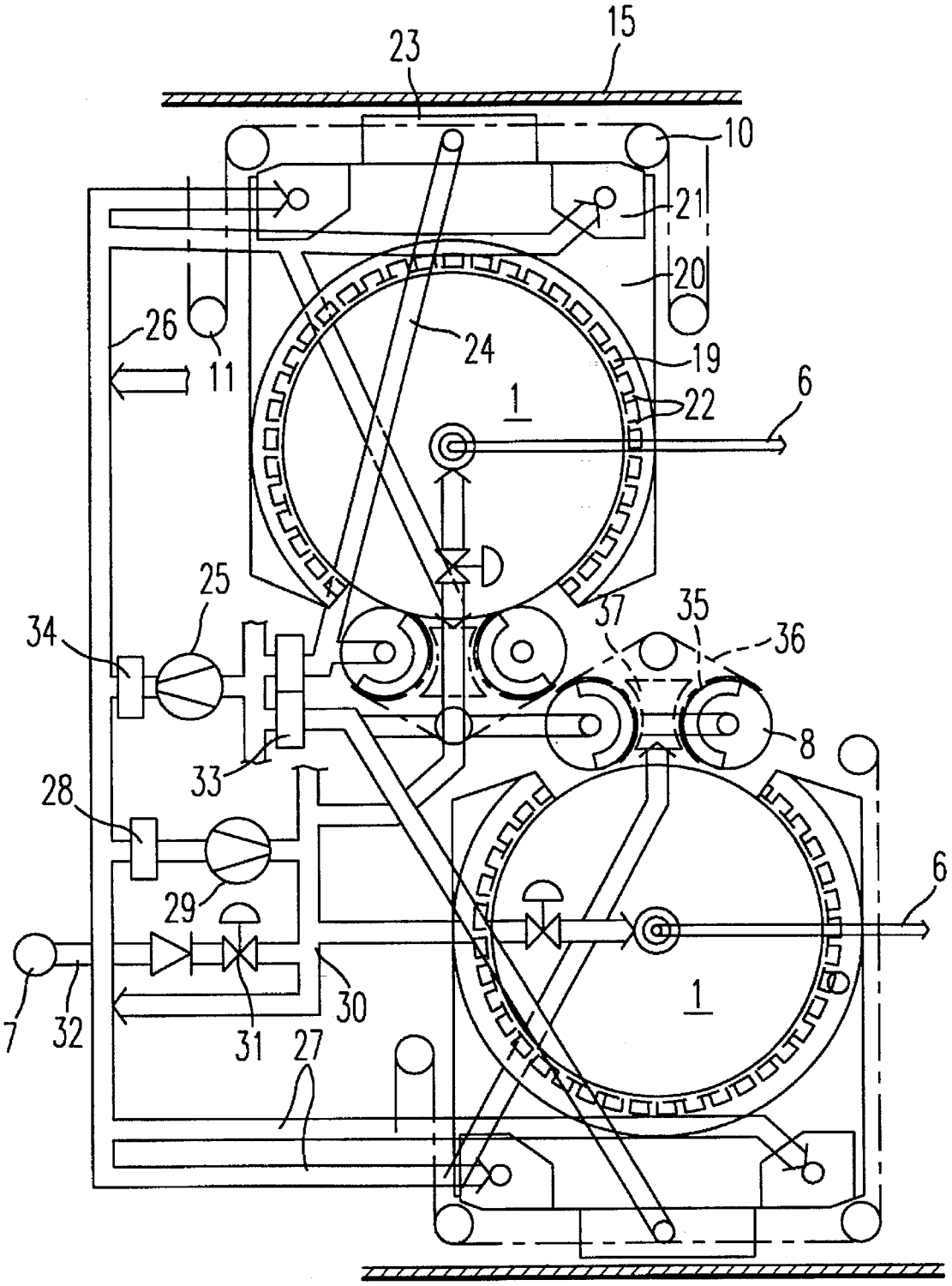
FIG. 9 is a schematic representation showing the flow of the stream circulated in the drying apparatus of FIG. 7.

A drying apparatus in accordance with a third embodiment of the invention will be explained with reference to the cross sectional views shown in FIGS. 7 and 8 and using the general steam circuit shown in FIG. 9.

As is the case with the first embodiment, a double row multi-cylinder arrangement is adopted, and, in each group of cylinders, the lower row of drying cylinders 1 are installed on the lower dryer frames 4 with the shafts 2 being rotatably supported thereon through suitable bearings 3. However, in this embodiment, upper dryer frames 4" are constructed separately from the lower dryer frames 4. Specifically, the machine foundations 13 for the lower dryer frames are extended forwardly at the operational side of the machine, and additional sole plates are anchored thereto. Then, bridging frames are built on the sole plates on the extended foundations, and the upper dryer frames 4', which are arranged immediately above the lower dryer frames 4, are fixedly secured to the bridging frames through horizontal frames. Thus, each of the upper row cylinders 1 is installed on the upper dryer frames 4' with the shafts 2 being rotatably supported thereon through the bearings 3. By adopting this overhang arrangement of the upper dryer frames 4', the middle hood 17 disposed between the upper and lower canopy hoods 15 can be accessed more readily, and cleaning or maintenance operations, such as replacing of the endless fabric belts 36, can be carried out more quickly.

In this embodiment, a pair of suction fabric rolls 8 and a pocket gas supply box 37 are arranged at the entry/exit pocket portion for each dryer cylinder 1. The pocket supply box 37, which is located between the pair of suction fabric rolls 8, is fixed in place by attaching the opposite ends to the side panels of the middle hood 17, and is provided with doctor blades both at the entry and exit sides so as to come into contact with the outer peripheral surface of the associated dryer cylinder 1. Those surfaces of the pocket supply box 37 which face the suction fabric rolls 8 with appropriate spacings formed therebetween are formed in an arcuate shape when viewed in a side direction, and a plurality of blast openings (slits or circular holes) are provided in a respective arcuate surface. The upper suction fabric rolls 8 are rotatably supported on the upper dryer frames 4', whereas the lower suction fabric rolls 8 are rotatably supported on the lower dryer frames 4.

In operation, the wet paper web 35 enters the entrance of the first lower cylinder 1 by being sandwiched between the two endless fabric belts 36. Then, the paper web 35 is pulled by the suction fabric roll 8 downwards, and is heated by the super-heated steam, having a temperature in excess of 100° C., blown through the entry side of the pocket supply box 37 against the wet paper web 35. The paper web 35 then travels by being separated from the upper endless fabric belt 36, and the super-heated steam, which passes through the paper web 35 and the endless fabric belt 36, is withdrawn by the suction fabric rolls 8 and is recirculated together with the steam evaporated from the paper web 35. The moist paper web 35 is going to be dried at the entrance under the restrained condition by the pressure of the superheated steam in excess of 100° C. coming from the pocket supply box 37, in cooperation with the suction effects provided by the suction fabric roll 8. Then, the paper web 35 is further dried with its top surface being in contact with the dryer cylinder 1 and with its bottom surface being strongly pressed by the endless fabric belt 36 aided by the action of the fabric tension rolls 11. Thus, a restrained drying is effected. When the paper web 35 reaches the exit of the first lower dryer cylinder 1, it is pulled upward by the second suction fabric roll 8, and is pulled away from the dryer cylinder 1 by the superheated steam (in excess of 100° C.) blown through the exit side of the pocket supply box 37. The paper web 35 then goes upwards around the suction fabric roll 8 so as to come into contact with the upper endless fabric belt 36, and is held between the two endless fabric belts 36, and reaches the entry side of the upper dryer cylinder 1. In the upper drying section, the paper web 35 is pulled by the third suction fabric roll 8, and by the superheated steam (in excess of 100° C.) blown from the entry side of the upper pocket supply box 37 against the paper web 35. The paper web 35 then travels by being separated from the bottom endless belt 36. The process described above is repeated to dry the paper web 35.

In this embodiment, the doctor blades provided on each pocket supply box 37 are used to clean the surface of the associated dryer cylinder 1, and also prevent the paper web 35 from being held up in the pocket section by debris or by sagging of the paper web 35. They are also useful when scraping sticking paper web 35 away from the surface of the dryer cylinder 1.

Furthermore, since the dryer frames are separated into upper frames 4' and lower frames 4, those frame portions acting as obstacles to interfere with opening and closing of the door to the middle hood 17 have been eliminated. By having this arrangement, it is possible to construct the middle hood 17 so that it can be withdrawable in every section, or openable, or doors may be provided. Additionally, handling of the pocket supply boxes 37 is made easier.

Furthermore, in the foregoing three embodiments, an atmosphere of superheated steam having a temperature in excess of 100° C. is used as a drying atmosphere. However, an atmosphere of heated moist air having a dew point of at least 80° C. may be instead employed as the drying atmosphere without any significant modifications to the construction of the drying apparatus. The use of the aforesaid heated moist air atmosphere to the first embodiment will be hereinafter described.

More specifically, in the drying apparatus having quite the same construction as in the first embodiment, a wet paper web 35 having 50–60% of moisture is fed into the closed hood and sandwiched between the upper and lower endless fabric belts 36 to reach the first lower dryer cylinder 1. The paper web 35 is then pulled downwards by the suction action of the suction fabric roll 8, and passes on the dryer cylinder 1 while restrained by the cylinder 1 and the fabric belt 36. When the paper web 35 passes over the first dryer cylinder 1 and is released from the first dryer cylinder 1 at the exit by being pulled by the second suction fabric roll 8, it is again sandwiched between the two endless fabric belts 36 to reach the entrance to the second dryer cylinder 1, and the drying process is repeated over again as described above.

In the above process, the steam evaporated from the wet paper web 35 is sucked in through-the suction ports 22 and the suction fabric rolls 8 to reach the emission screen 33 via the suction ports 23 and the suction ducts 24. After the foreign particles are removed by the emission screen 33, the steam pressure is increased by the steam circulation fan 25. The steam is then heated at the exit by the superheated steam from the adiabatic expansion nozzle 26 preferably to a dry bulb temperature of no less than 150° C., and most of this steam is directed to the paper web 35 after passing through the ducts 27, the supply boxes 20, the blast ports 19 and through the endless fabric belts 36. The blasting or impinging action drives out the stagnant moisture from the voids within the endless fabric belts 36. This action not only heats the paper web 35 directly but also disturbs the boundary layer containing the saturated steam above the paper web 35 to promote evaporation of the moisture in the paper web 35, and produces an atmosphere of heated moist air having a dew point temperature in excess of 80° C. In the foregoing, it is more preferable that the drying atmosphere be regulated such that the interfaces between the dryer cylinder 1 and the wet paper web 35 have a dew point temperature of close to 100° C. while the other portions have a dew point temperature in excess of 80° C.

A part of the steam pressurized by the circulation fan 25 is circulated in the same manner as in the first embodiment.

Figure 1:
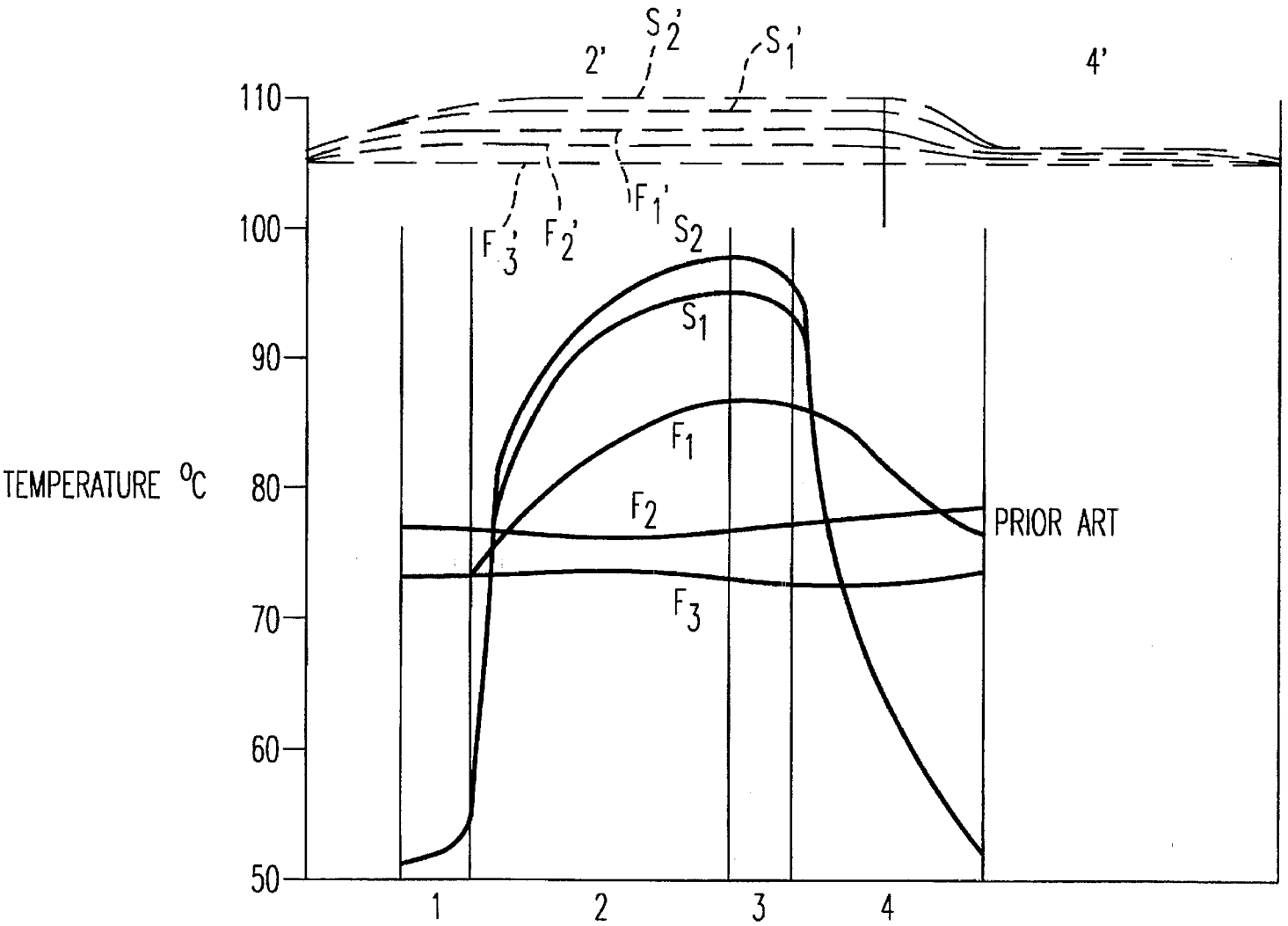
FIG. 1 is a diagrammatical representation showing a temperature distribution in a paper web and in a fabric belt for comparing the drying process of the invention employing superheated steam and the conventional process.
Figure 2:
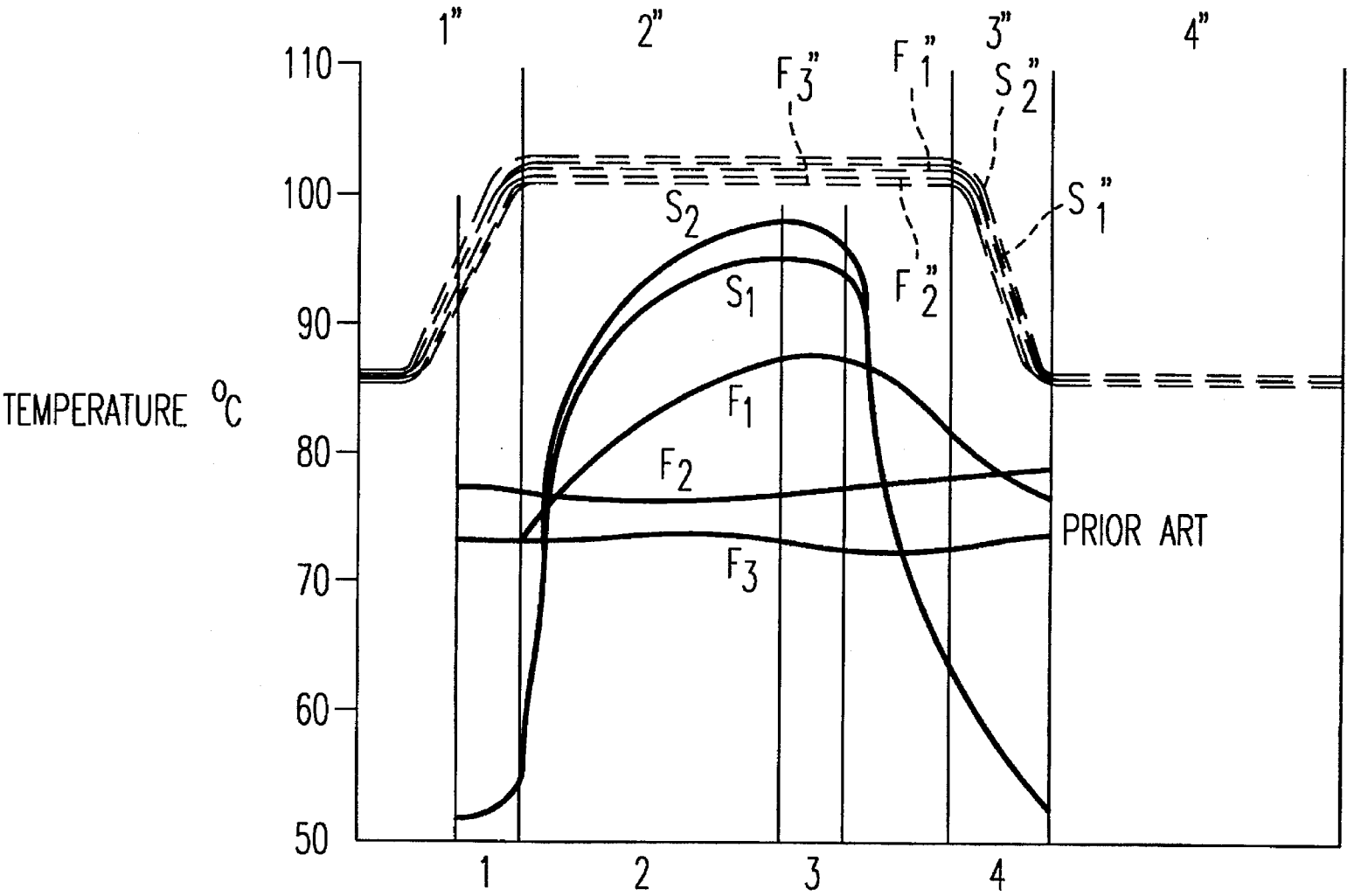
FIG. 2 is a diagrammatical representation similar to FIG. 1, but showing the drying process of the invention when heated air containing superheated steam is employed.

Thus, the atmosphere of heated moist air can be produced to achieve advantages as described before in conjunction with FIG. 2.

Figure 11:
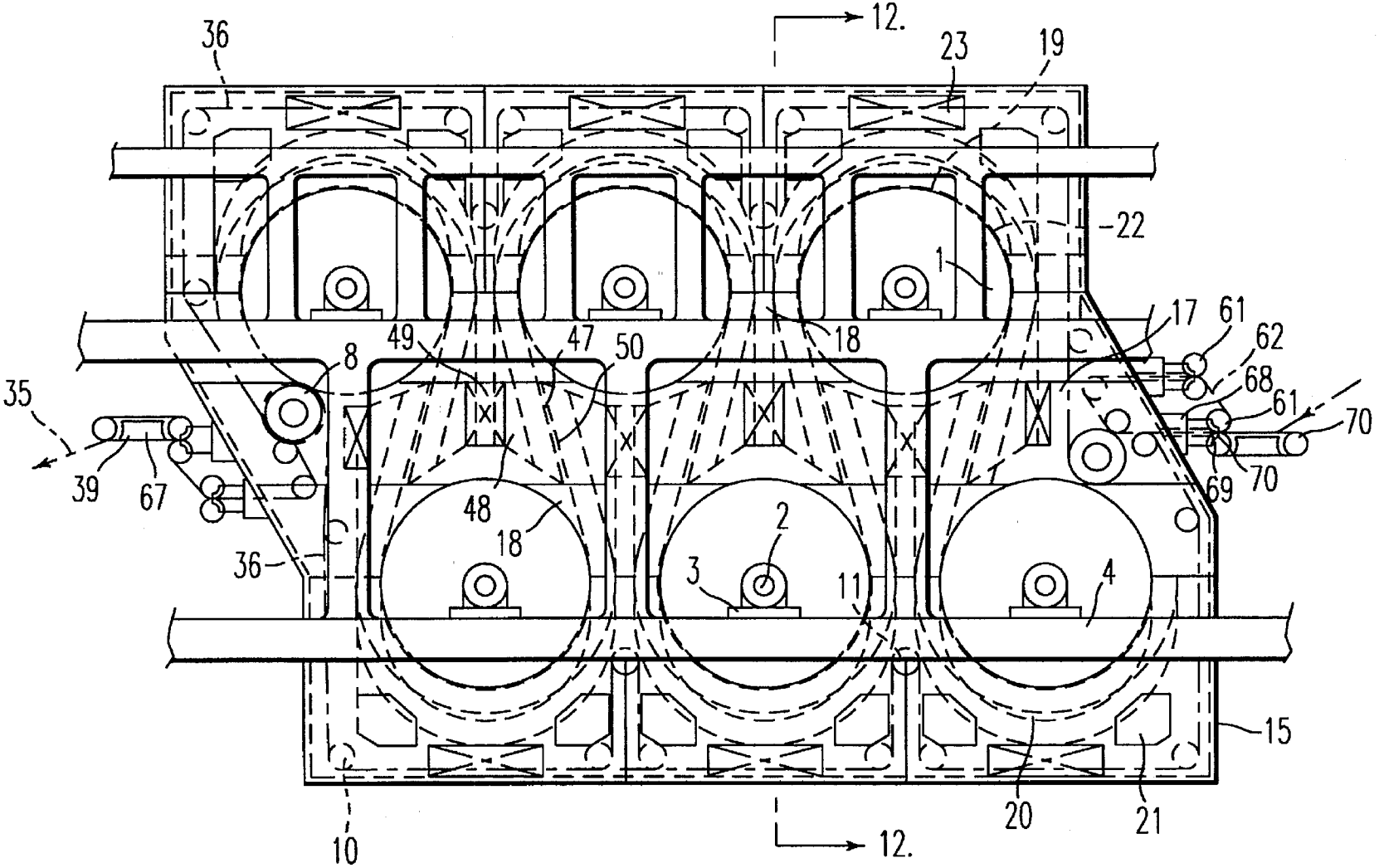
FIG. 11 is a side elevational view showing a drying apparatus in accordance with a fourth embodiment of the invention.
Figure 12:
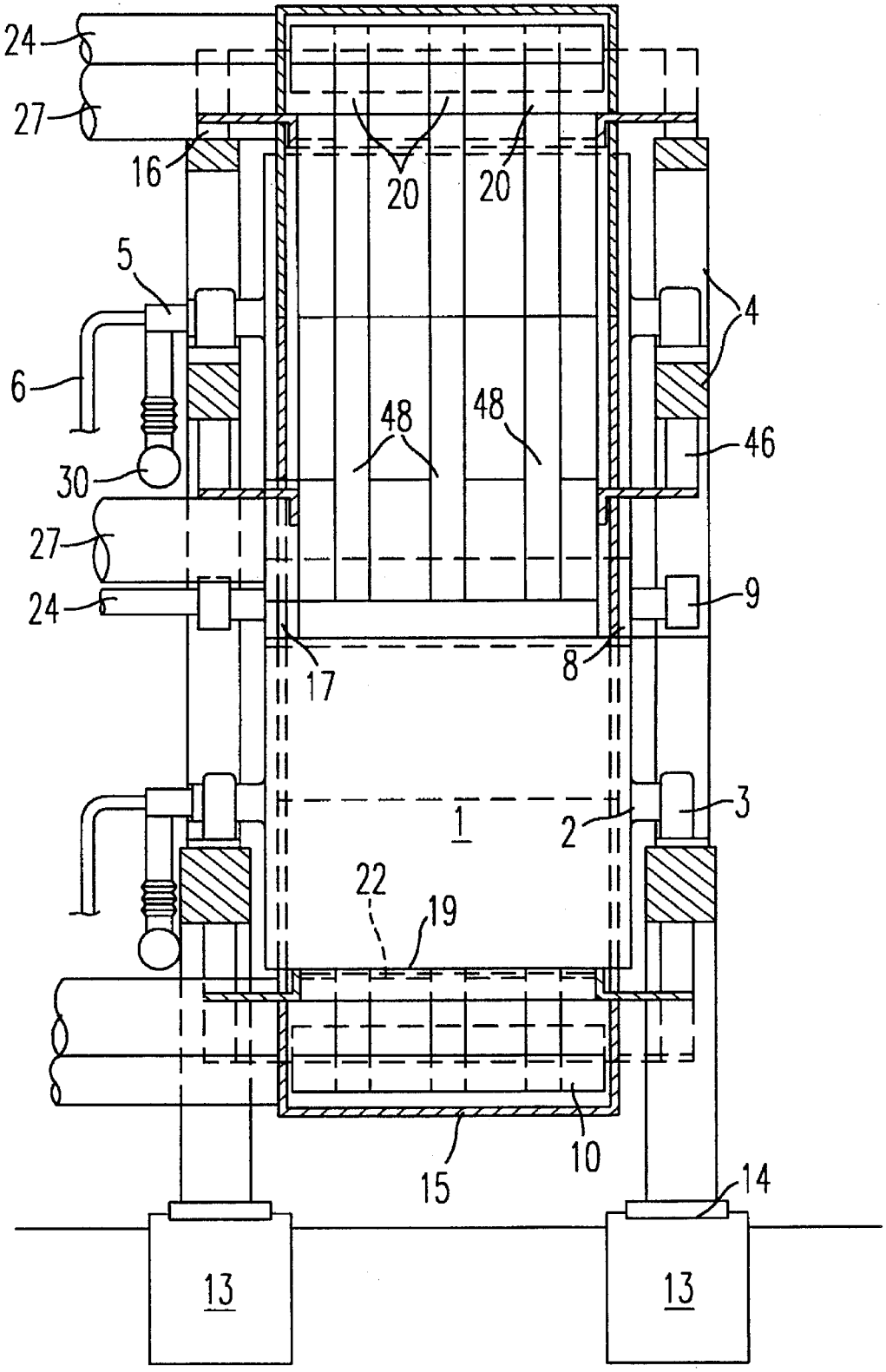
FIG. 12 is a cross-sectional view taken along the lines XII—XII in FIG. 11.
Figure 13:
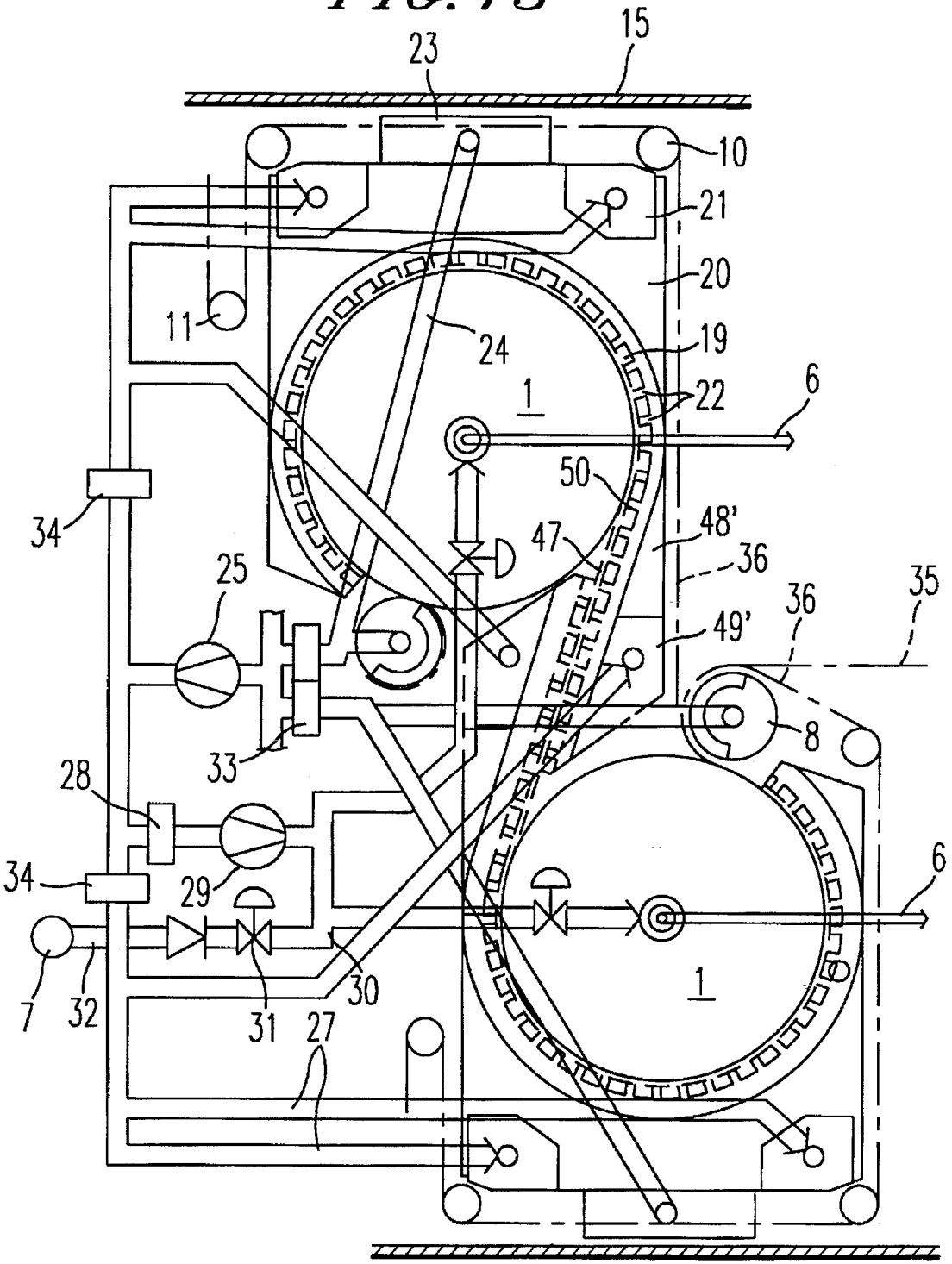
FIG. 13 is a view similar to FIG. 5, but showing the system of the apparatus of FIG. 11.

Moreover, a fourth embodiment in accordance with the invention will be described with reference to FIGS. 11 to 13. As can be seen from FIG. 11, the drying apparatus in accordance with this embodiment has a double row multi-cylinder arrangement basically similar to that of the first embodiment. However, in this embodiment, even the entry and exit openings formed through the middle hood 17 for entering/exiting of the paper web 35 are closed by means of suitable sealing devices (described later) to provide a completely closed drying chamber in the hoods.

Furthermore, inside the hoods, there are provided a plurality of first steam-supply boxes 20 of an annular shape associated with a respective dryer cylinder 1 so as to substantially surround the outer peripheral surface thereof, and a plurality of second steam-supply boxes 48 of a generally triangular shape connecting the adjacent supply boxes 20, these supply boxes being spaced axially of the dryer cylinder 1. Provided in association with the supply boxes 20 are a blast unit comprised of a plurality of elongated tubular members of a rectangular-shaped cross-section arranged arranged around the cylinder 1 in circumferentially spaced relation and each having a great number of blast or blower ports (first blower ports) 19 formed in the surface facing the dryer cylinder 1. In addition, there is provided a further blast unit which comprises a plurality of elongated tubular members of a rectangular-shaped cross-section arranged along the path, extending between adjacent upper and lower cylinders 1 tangentially and diagonally, in longitudinally spaced relation, and each having second blast ports 47 formed in the surface facing the above-mentioned path. Furthermore, there are provided suction units, each of which comprises a plurality of elongated suction ports 22 and 50 defined by the spacings between adjacent blast ports 19 and 47, respectively. Thus, the blast ports 19 and 47 and the suction ports 22 and 50 are arranged on a continuous curved plane comprised of a plurality of horse-shoe shaped planes connected in series. The blast ports and the suction ports may be of either slit or circle shape, and it is preferable that the spacing between the blast ports and the paper web be about 10~25 mm. The blast units and the suction units are connected separately to the suitable canopy hoods 15 and middle hood 17.

Furthermore, a plurality of connecting ducts 21 and 49, which are connected to the supply boxes 20 and 48, are connected at the driving side of the dryer to drying medium-supply ducts 27 through suitable flexible joints.

In the foregoing, the blast ports 47 and the supply boxes 48 may be attached to base frames arranged inside the hood 17 so as to be adjacent to the drive and operational sides thereof. And, one or more connecting bases extending from the base frames through the middle hood panelling outwards may be connected to right and left escape devices 46 disposed outside the hood, the escape devices being capable of pivoting or moving forwards and backwards. The through holes in the insulating panelling are closed by a flexible sheet to shut off the hood from outside. Additionally, the numeral 49' denotes connecting ducts for the suction boxes 48'.

The arrangements of the hoods may be modified in the same manner as in the first embodiment.

Fabric rolls 10 are provided on the corners of the hoods, and a suitable sealing device is provided at each of the entrance and exit of the hoods covering each group of dryer cylinders 1. Fabric tension rolls 11 are also provided at suitable locations so that upper and lower gas-permeable endless fabric belts 36 can travel inside the totally sealed hoods. suction boxes 23, to which the suction unit is connected, are disposed adjacent the supply boxes at upper parts of the upper canopy hoods 15 and at lower parts of the lower canopy hoods 15, and are connected at the driving side to suction ducts 24 through flexible joints.

Figure 14:
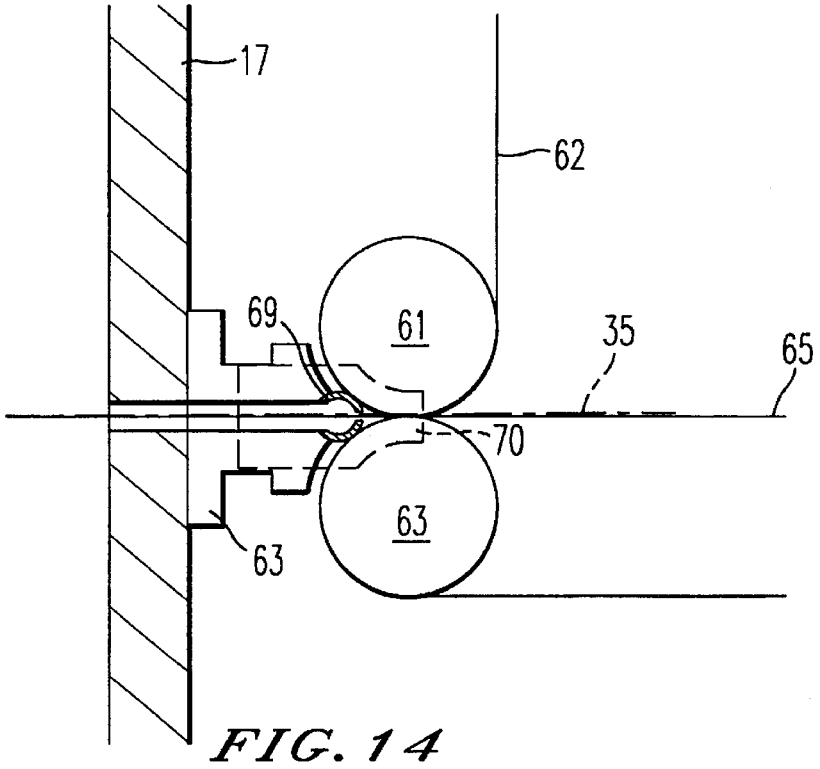
FIG. 14 is a cross-sectional view showing a basic construction of a sealing device which may be attached to the apparatuses of FIGS. 3, 6, 8, 10, 11 and 19.
Figure 15:
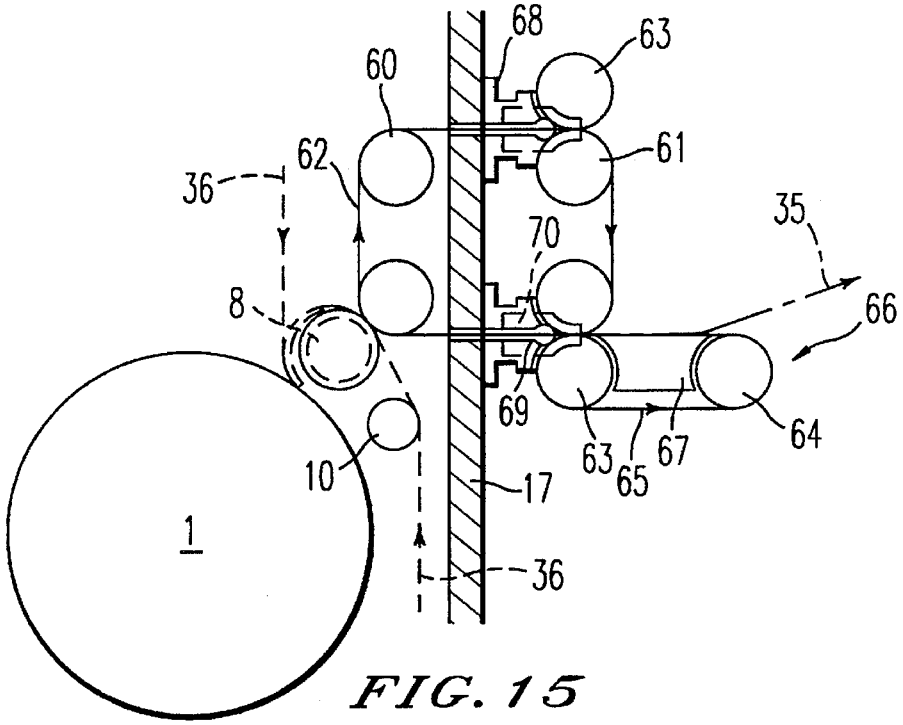
FIG. 15 is a cross-sectional view showing a sealing device provided at an entrance side of the apparatus of FIG. 11.
Figure 16:
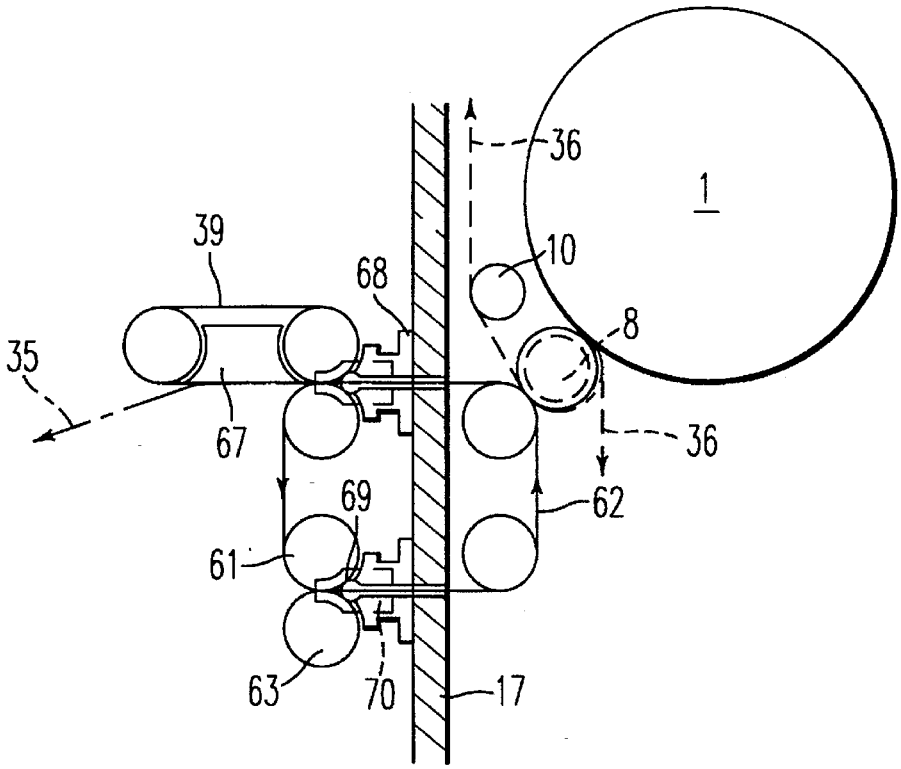
FIG. 16 is a cross-sectional view showing a sealing device provided at the exit side of the apparatus of FIG. 11.

FIGS. 14 to 16 show sealing devices which are located at the entrance and the exit of the middle hood. FIG. 14 is an enlarged view depicting a basic construction of the device, while FIGS. 15 and 16 depict an entrance side-sealing device and an exit-side sealing device, respectively. The exit-side sealing device differs from the entrance-side sealing device only in that it is in a reverse and upside-down relationship to the entrance-side sealing device shown in FIG. 15 or 16.

Referring to FIGS. 14 and 15, the sealing device includes one or more (two in the illustrated embodiment) inner sealing rolls 60 arranged inside the hood, one or more (two in the illustrated embodiment) outer sealing rolls 61 located outside the hood 17, a blanket 62 formed for example of a heat-resistant rubber and looped around the inner and outer sealing rolls, a suitable drive means (not shown) for causing the blanket to travel around, and a suitable tension device (not shown) for keeping the tension of the blanket as appropriate. The blanket is solid because it brings air into the closed hood if it has voids in it. A sealing pinch roll 63 for accommodating linear load of 5 kg/cm width is arranged in opposed relation to the outer sealing roll 61, and another conveyor roll 64 is coupled to the sealing pinch roll, and a conveyor belt 65 is looped therearound to define a conveyor device 66 for facilitating the feeding of the paper web 35. In this conveyor device 66, a suction box 67 is provided between the rolls. Furthermore, a suitable belt material which has voids (mesh, slits or circular holes) for enabling sucking is used as the conveyor belt 65. A sealing frame 68 having an opening formed therethrough is mounted on the outer surface of the hood 17 with the opening in alignment with the entry opening of the hood, and a half-divided sealing pipe 69 is attached to the sealing frame 68 with one end of each half piece being fastened to the frame by suitable fastening means and with those portions adjacent to the other ends being held in sealing contact, at an appropriate linear load, with the outer blanket roll 61 and the pinch roll 63, respectively. Furthermore, a pair of sealing plate members 70 are fastened by suitable fastening means to the both sides of the sealing frame 68 with the inner surfaces being held in sealing contact with the opposite ends of each of the blanket roll 61 and the pinch roll 63. It is preferable that the plate members 70 be held in contact with the ends of the rolls by using springs or cylinder devices for enabling resilient and smooth contact.

Figure 17:
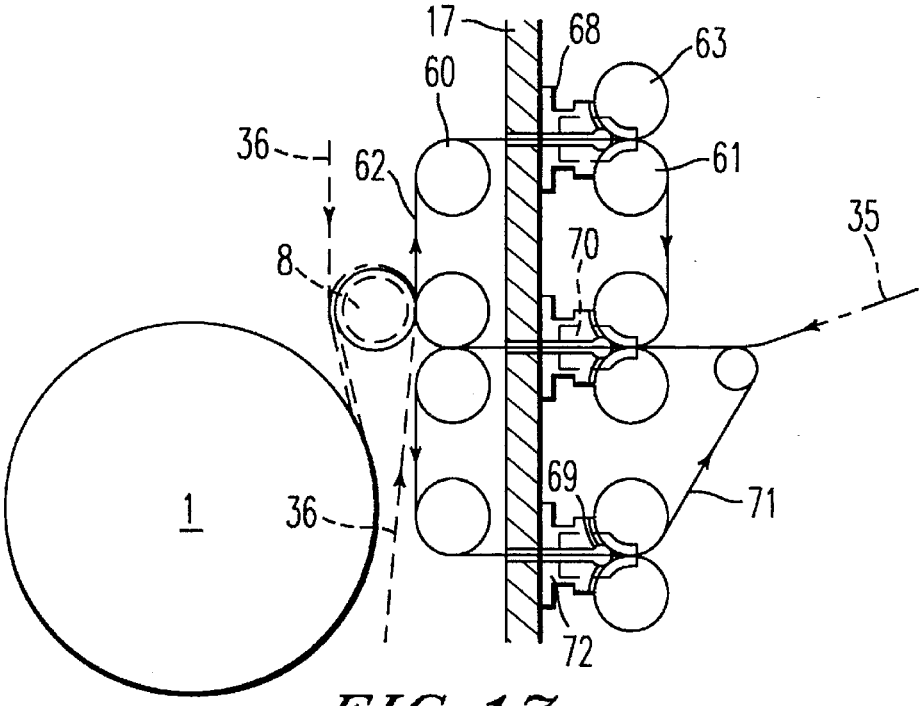
FIGS. 17 is a cross-sectional view showing a modification of FIG. 15.
Figure 18:
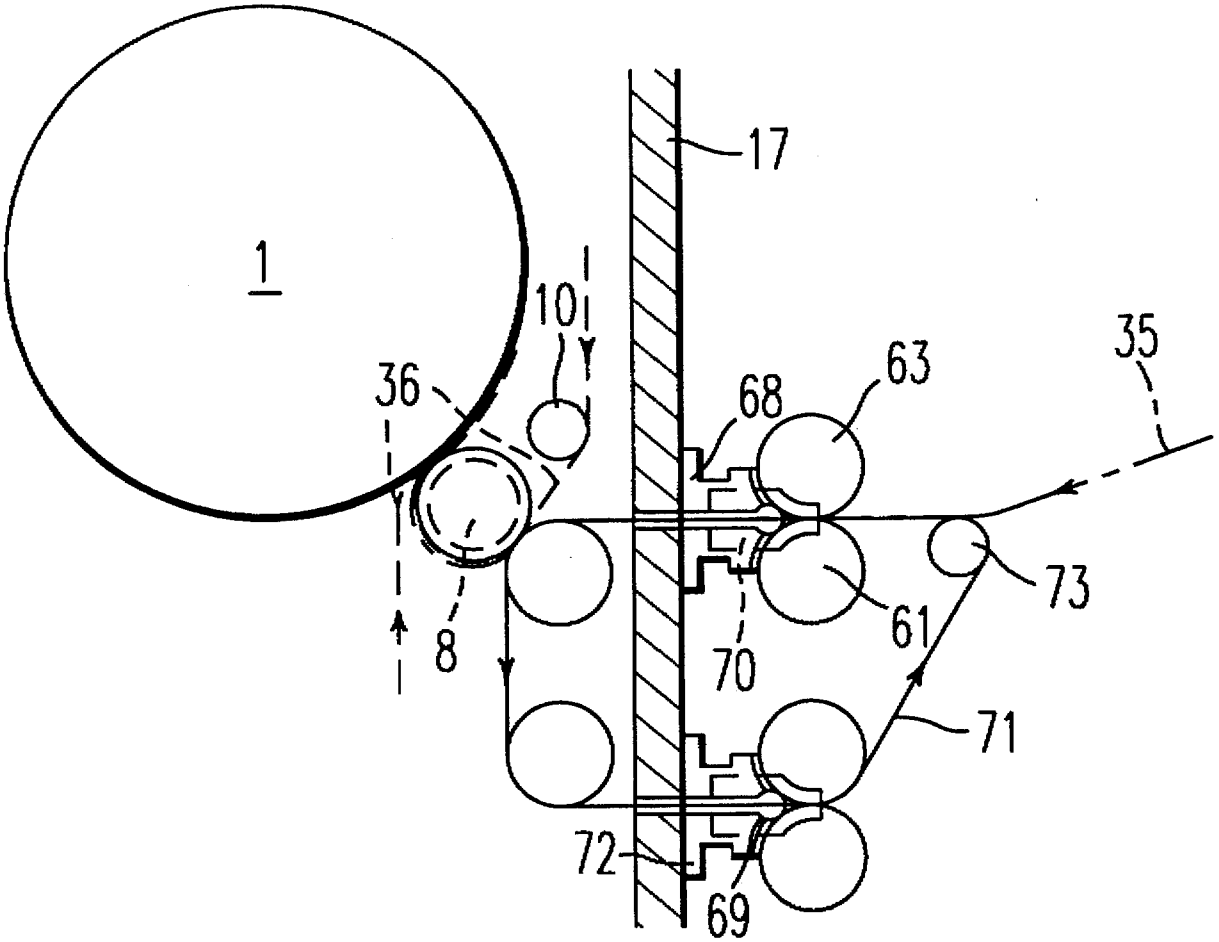
FIG. 18 is a cross-sectional view showing a further modification of FIG. 15.

FIGS. 17 and 18 depict modifications of an entrance side-sealing device. The corresponding exit-side sealing devices are not illustrated since each exit-side sealing device differs from the entrance-side sealing device only in that it is in a reverse and upside-down relationship to the entrance-side sealing device shown in FIG. 17 or 18. In FIG. 17, another sealing blanket 71, sealing frame 72, additional roll 73 and so on are employed to omit the paper web supply conveyor and to ensure a restrained feeding during passing of the paper web through the entrance opening. In FIG. 18, the upper blanket-roll assembly is omitted by providing a single sealing pinch roll 63, and the lower sealing blanket 71 is provided so as to travel and receive the paper web thereon, thereby omitting the supply conveyor.

Operation of the device of FIG. 18 is described as an example. The wet paper web 35 is fed on the sealing blanket 71, and introduced through the opening by the feeding action of the sealing pinch roll 63 and the sealing blanket roll 61 while shutting off the hood from the outside air into the hood, following which the paper web 35 is sucked in by the suction fabric roll 8 through the gas permeable endless fabric belts 36 to reach the first cylinder 1.

In this fourth embodiment, a wet paper web 35, which is led into the hood by the sealing device and sucked in by the suction fabric roll 8, is sandwiched between the upper and lower endless fabric belts 36 travelling inside the closed hood to reach the first lower dryer cylinder 1 located at the entrance of the hood. The paper web 35 then begins to pass on the dryer cylinder 1 while sandwiched between the two end less fabric belts 36. When the paper web 35 passes over the first dryer cylinder 1, the paper web 35 is still sandwiched between the two endless fabric belts 36, and reaches the entrance to the second dryer cylinder 1 disposed in the upper row, and the drying process is repeated over again as described above.

After the paper web 35 passes through the last dryer cylinder 1, it is transported outside the dryer hood through the exit sealing device.

In the foregoing, the steam, evaporated from the wet paper web 35 by the dryer cylinders 1 and the impingement flow of superheated steam, is sucked in through the suction ports 22 and 50 and the suction fabric rolls 8 to reach the emission screen 33 via the suction ports 23 and the suction ducts 24 of the canopy hoods 5. After the foreign particles such as paper dust are removed by the emission screen 33, the steam pressure is increased by the steam circulation fan 25. The steam is then heated at the exit by the superheated steam from the adiabatic expansion nozzle 26, and most of this steam is directed to the paper web 35 after passing through the ducts 27, the supply boxes 20, the blast ports 19 and through the endless fabric belts 36. The blasting or impinging action drives out the stagnant moisture from the voids within the endless fabric belts 36. This action not only heats the paper web 35 directly but also disturbs the boundary layer containing the saturated steam above the paper web 35 to promote evaporation of the moisture in the paper web 35, and produces an atmosphere of superheated steam in excess of 100° C., preferably about 150° C.

As is the case with the first embodiment, when it is required to quicken the drying process by further heating the circulating steam, the exhaust heater 34 operated by fuel or thermal medium can be used to indirectly heat the steam.

A part of the steam pressurized by the circulation fan 25 is sent to the steam scrubber 28 to remove foreign particulate matters and non-condensable gases. The steam is then adiabatically compressed by means of the steam compressor 29 to increase temperature and pressure, and most of this steam is sent to the dryer cylinders 1 via the pressurized pipes 30 to heat the cylinders 1. A part of this steam is used to heat the recirculated steam via the adiabatic expansion nozzle 26. Furthermore, the make-up pipe 32 is used to compensate for a deficient amount of steam. The flow rates of the circulating steam are regulated by adjusting the steam valve 31 to control the moisture percent of the paper web 35 to control the curling of the paper web 35 or adjusting the amount of steam supplied to the upper and lower dryer cylinders 1. In the foregoing, the elongated blast ports 19 may be each divided into a plurality of longitudinally separated zones so that the amount of steam blast differs from zone to zone, and it is thus possible to regulate the amount of steam blast in the cross direction of the dryer cylinder 1, to thereby control the uniformity of moisture percent of the paper web 35 in the cross direction thereof.

Figure 19:
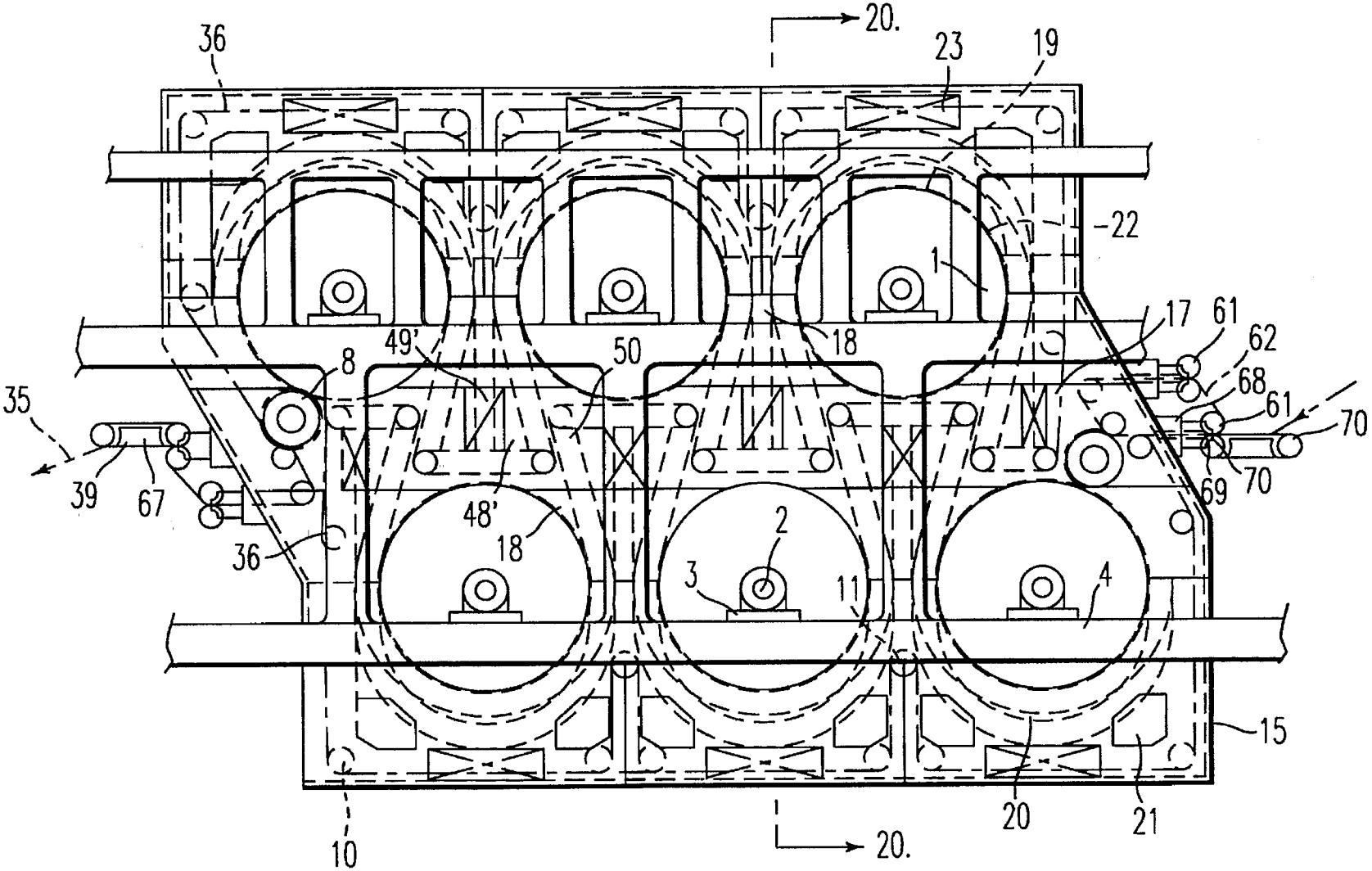
FIG. 19 is a side elevational view of a drying apparatus in accordance with a fifth embodiment of the present invention.
Figure 20:
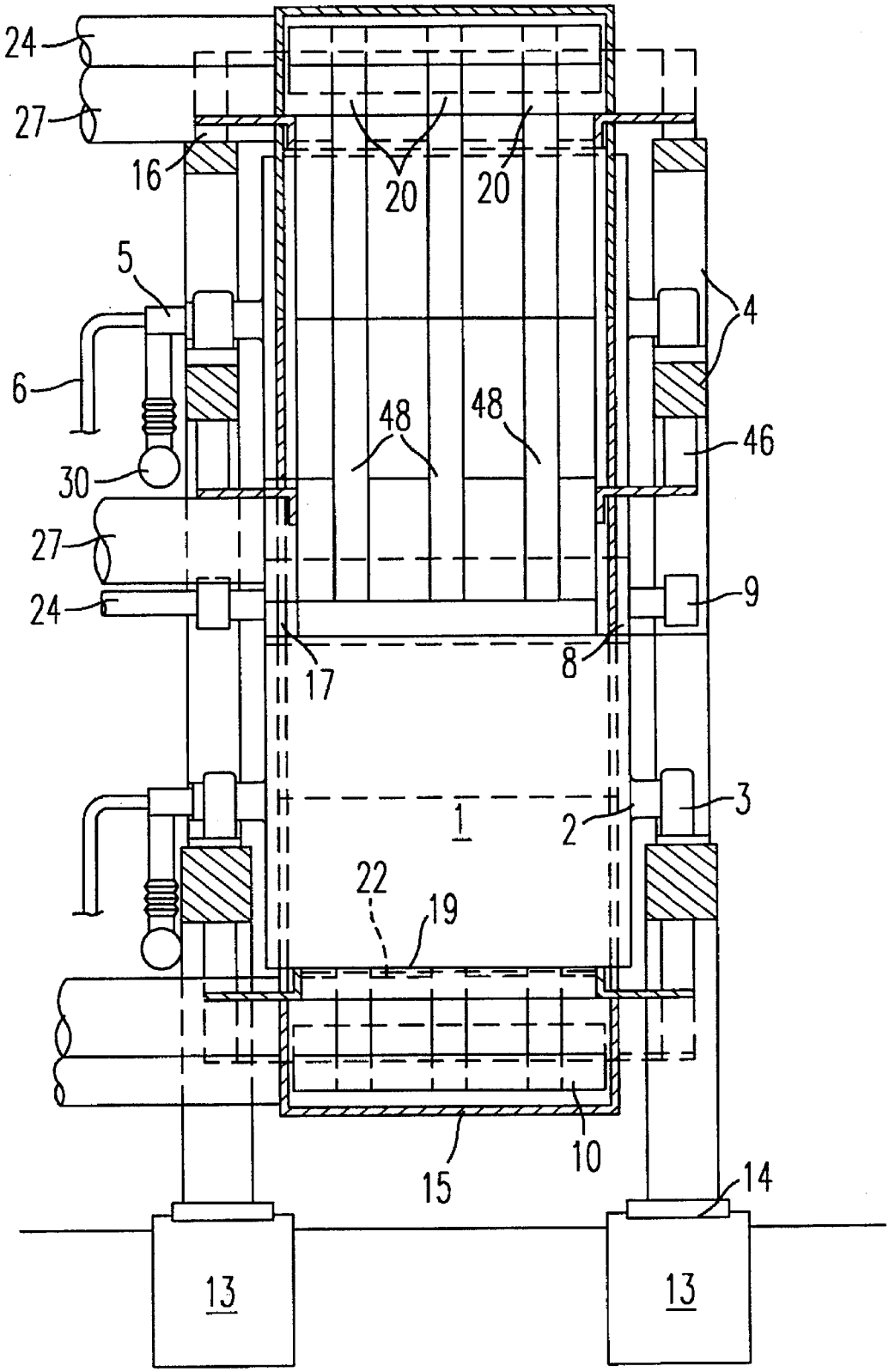
FIG. 20 is a transverse cross-sectional view of the apparatus of FIG. 19, taken along the lines XX—XX in FIG. 19.
Figure 21:
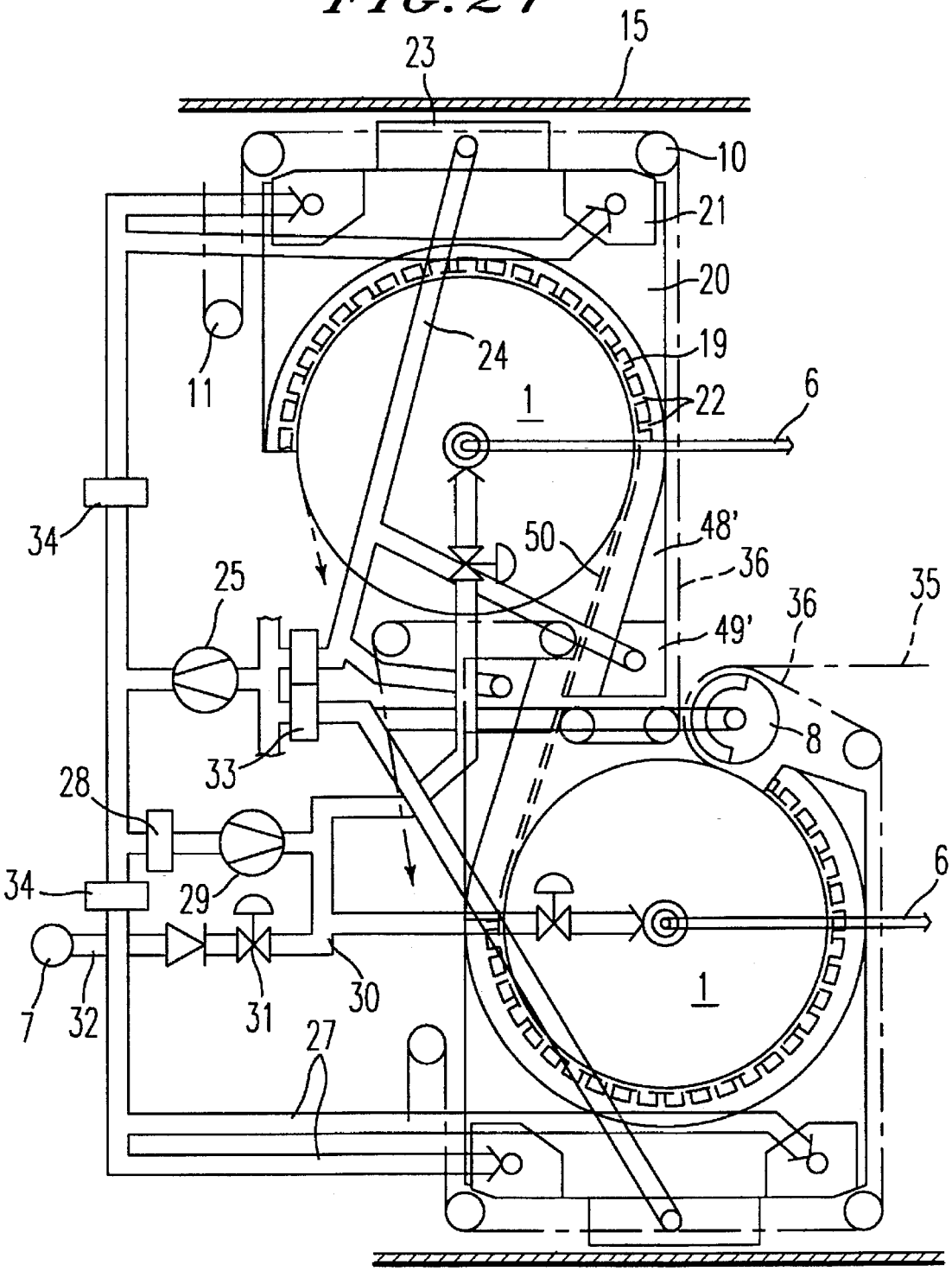
FIG. 21 is a view similar to FIG. 5, but showing the system for the apparatus of FIG. 19.
Figure 22:
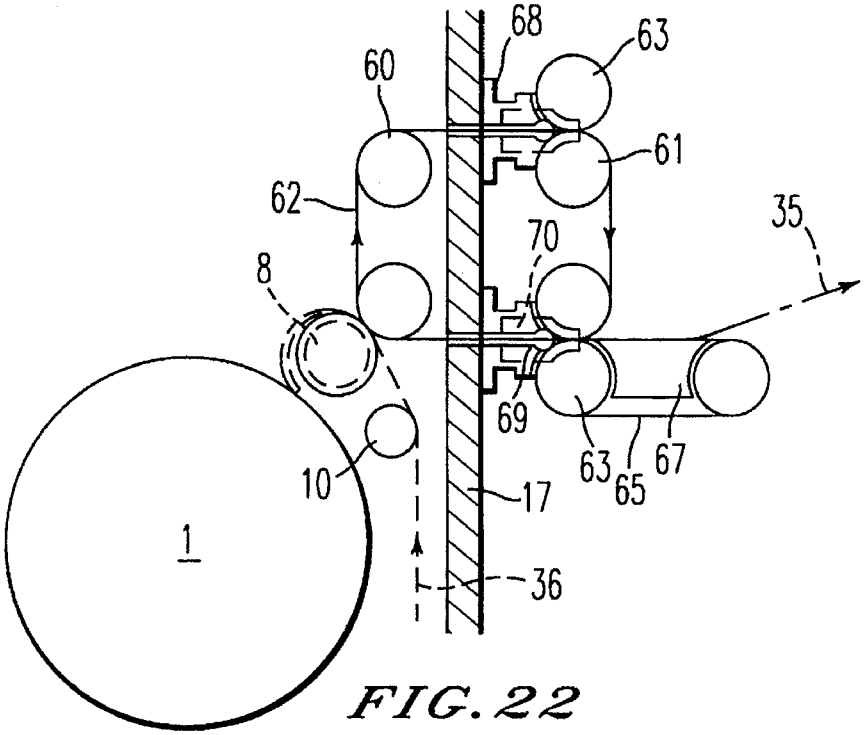
FIGS. 22 to 25 are cross-sectional views showing sealing devices and modifications thereof which may be attached to the apparatuses of FIG. 3, 6, 8, 10 and 19.
Figure 23:
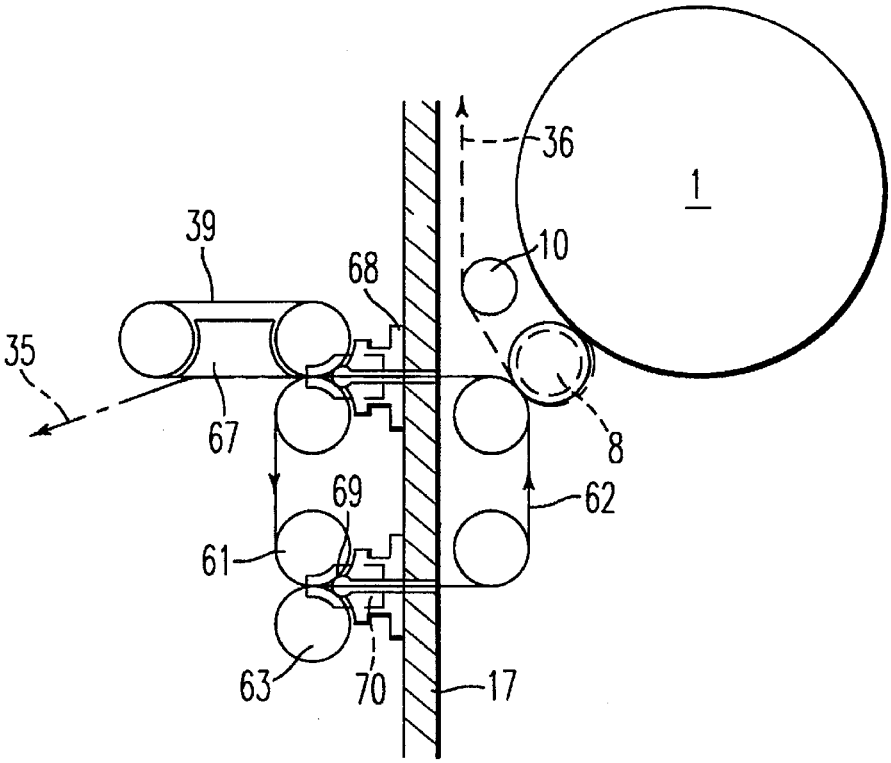
Figure 24:
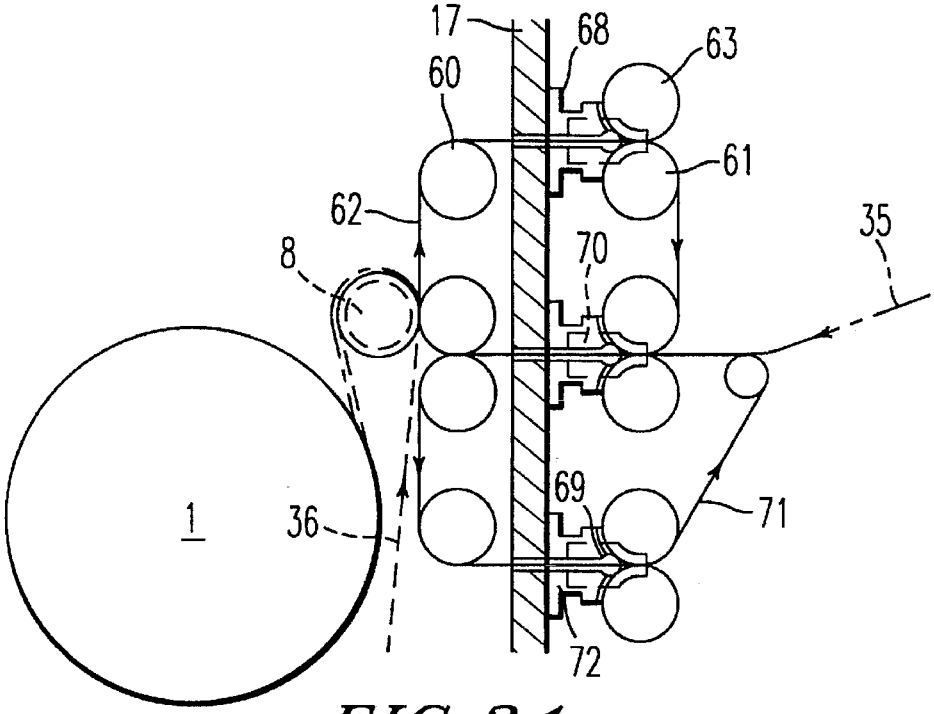
Figure 25:
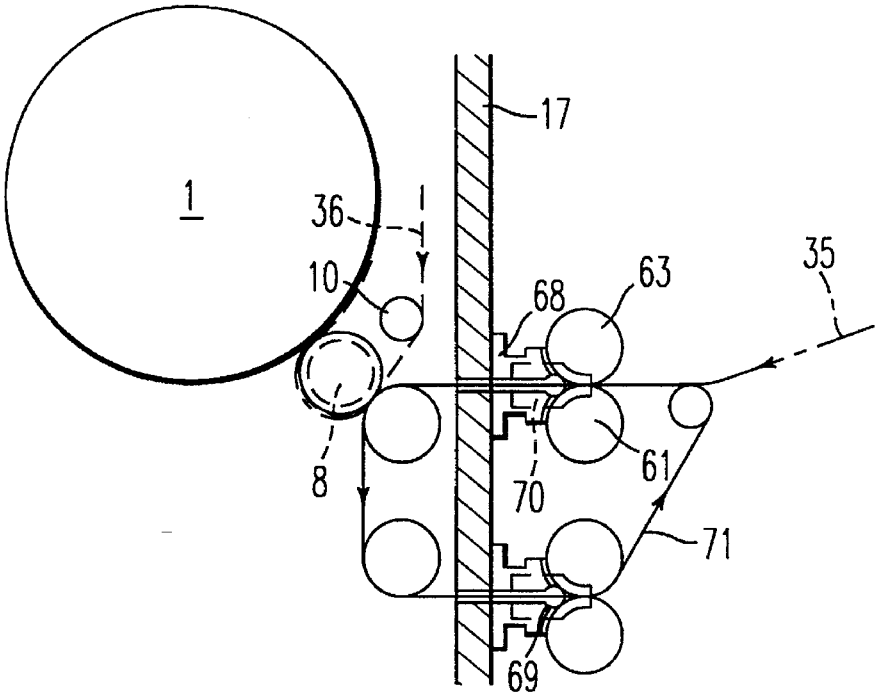
Figure 3:
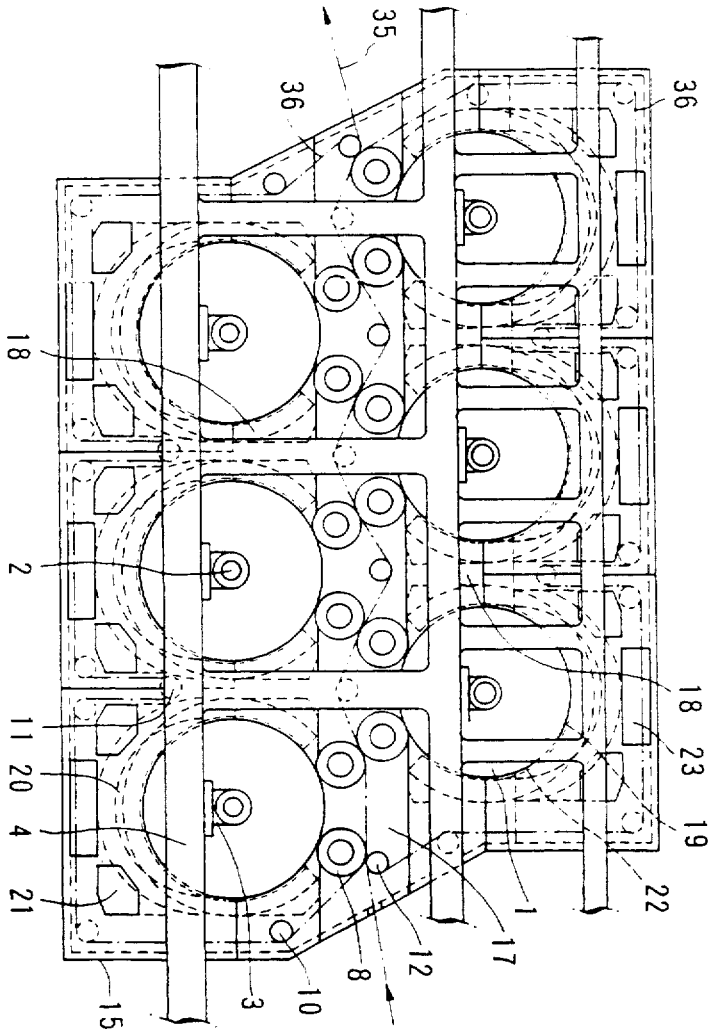
Figure 5:
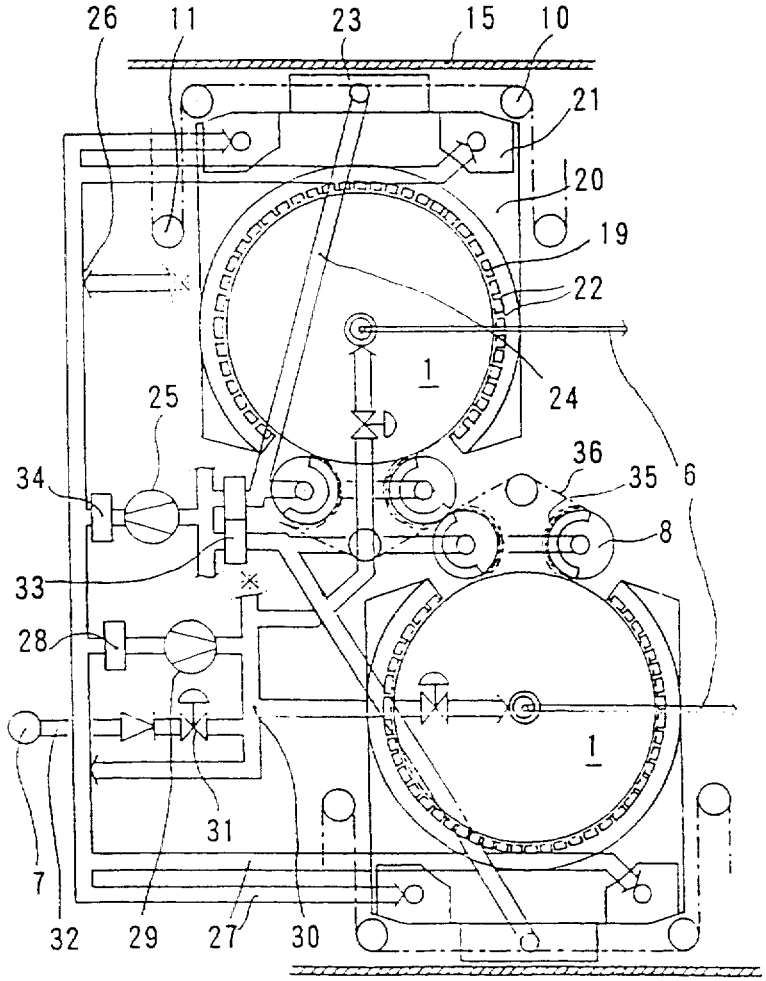
Figure 6:
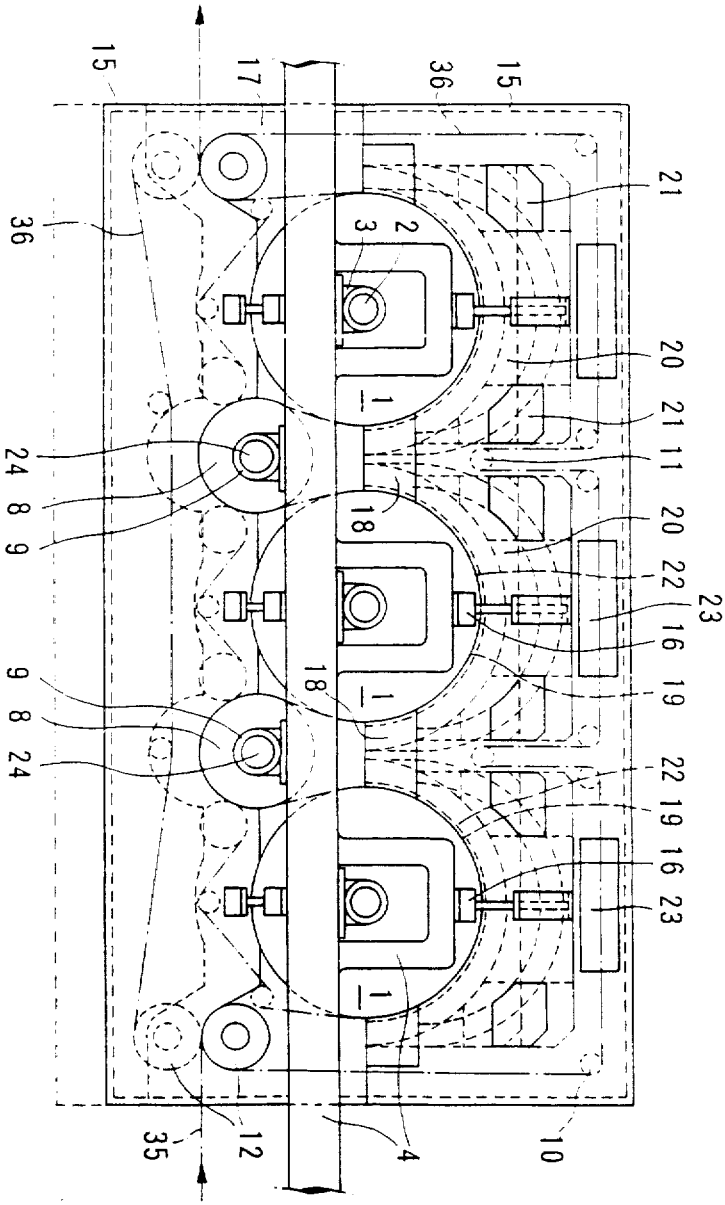
Figure 7:
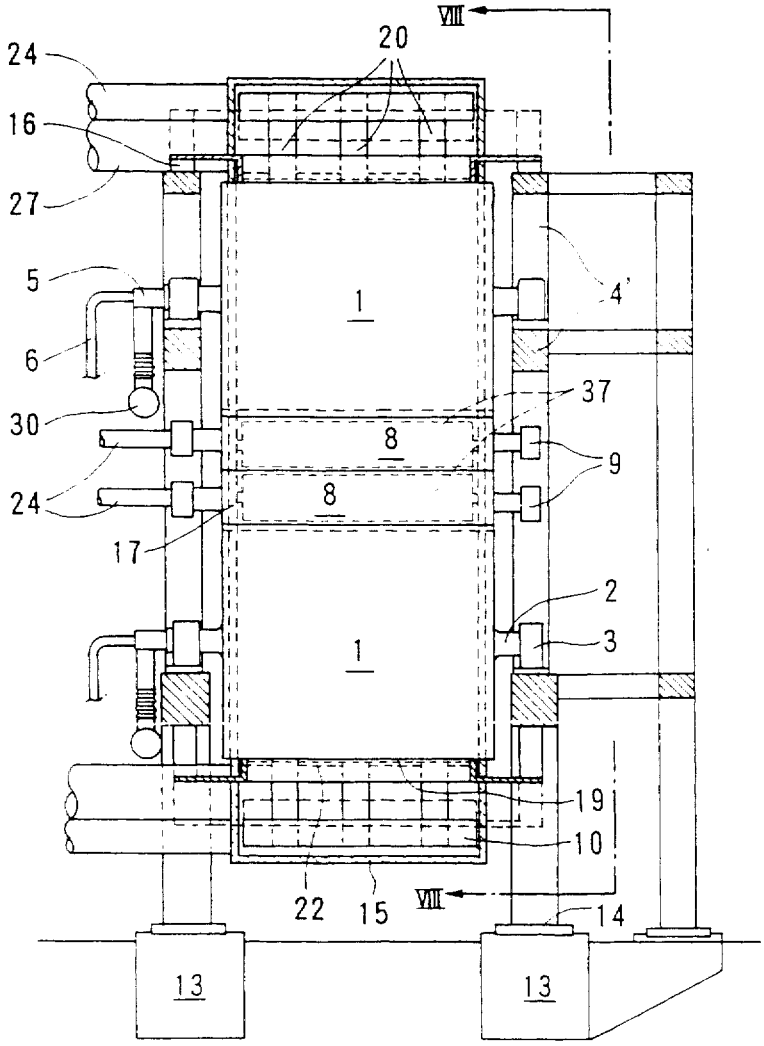
Figure 8:
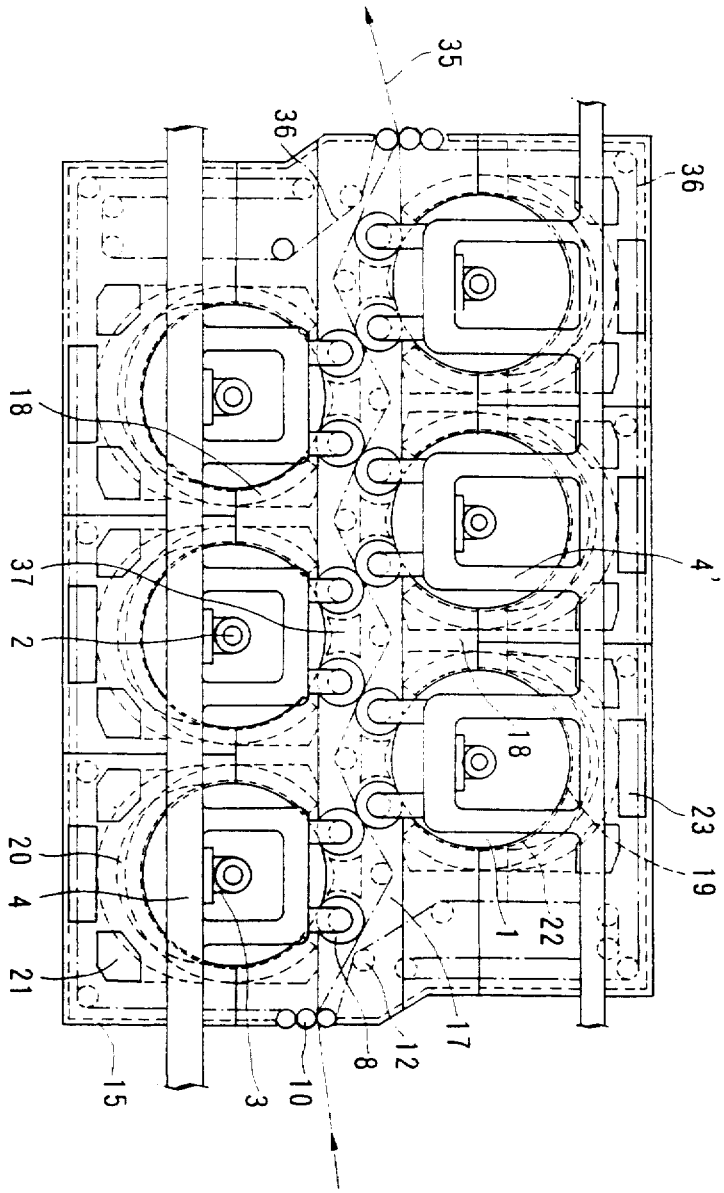
Figure 9:
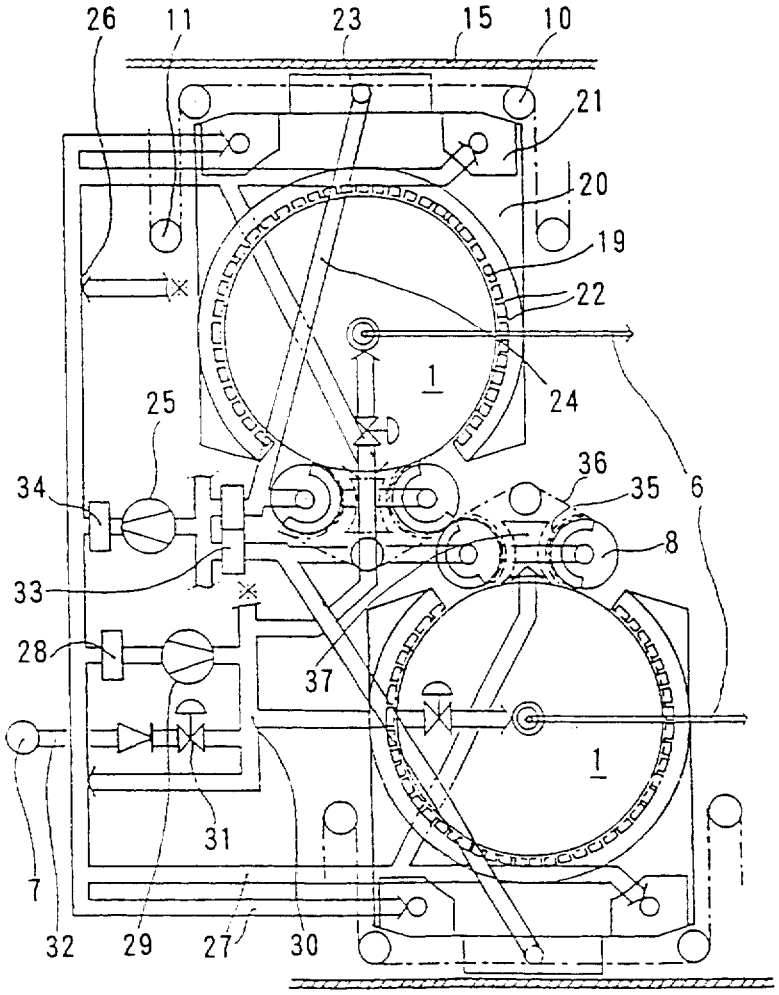
Figure 10:
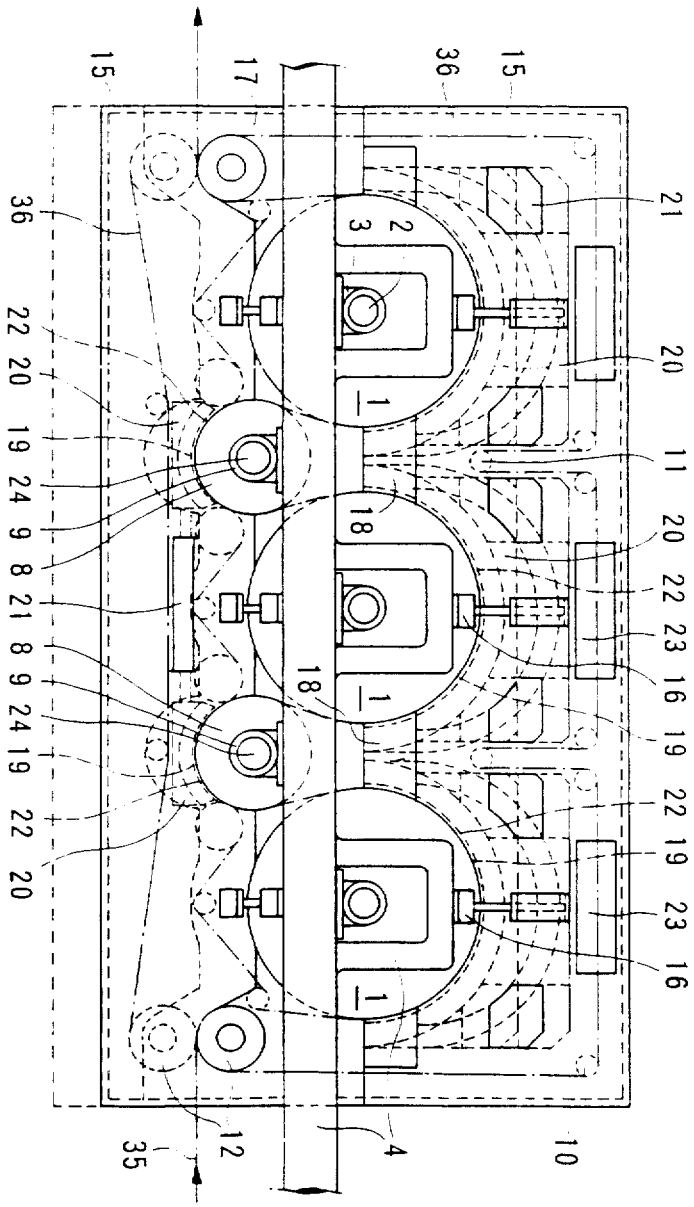
Figure 11:
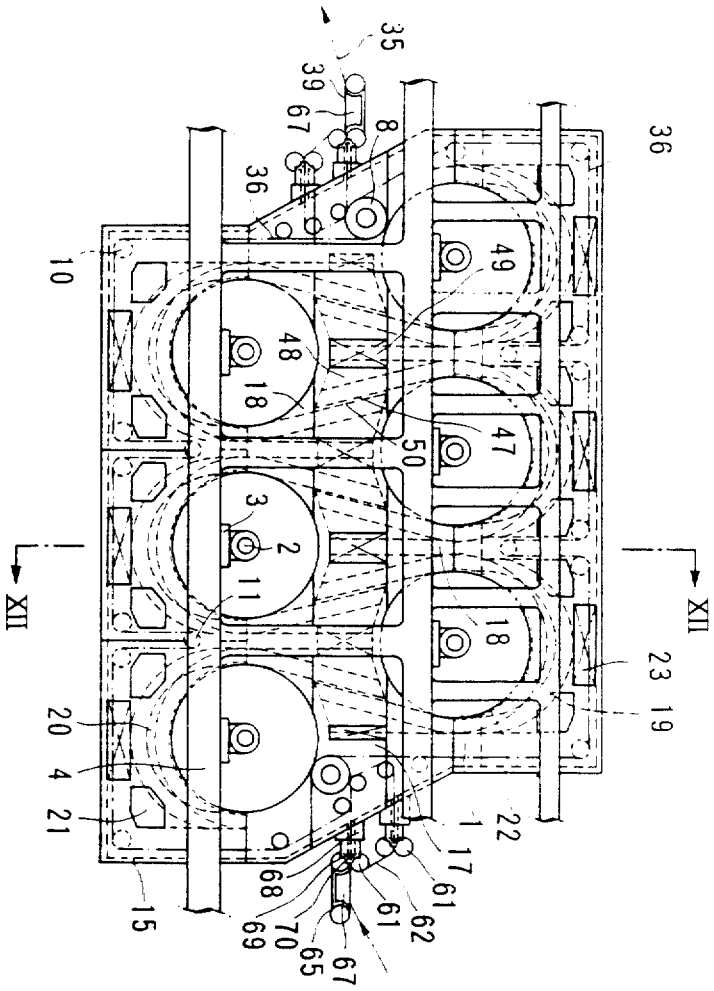
Figure 13:
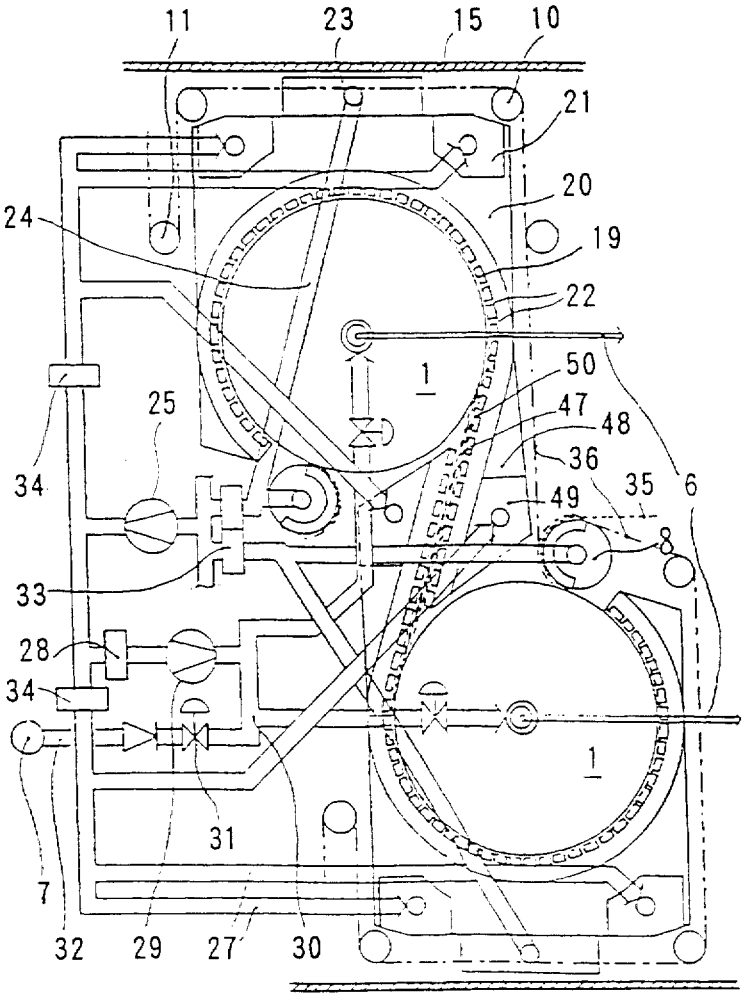
Figure 14:
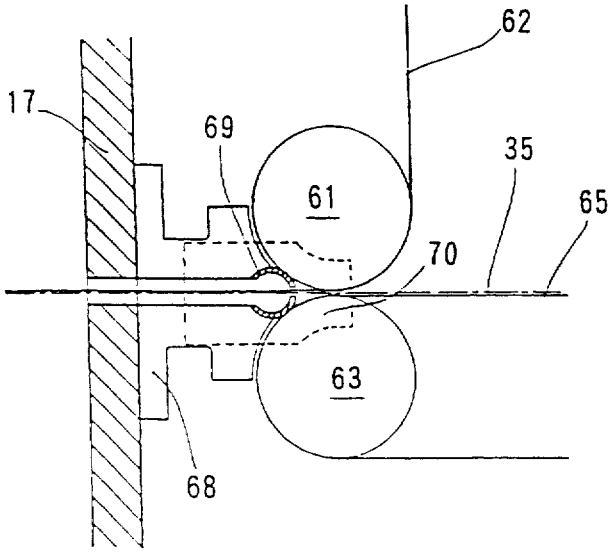
Figure 15:
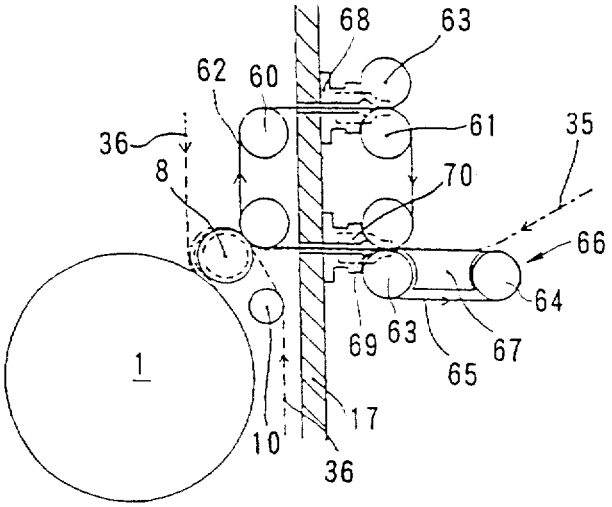
Figure 19:
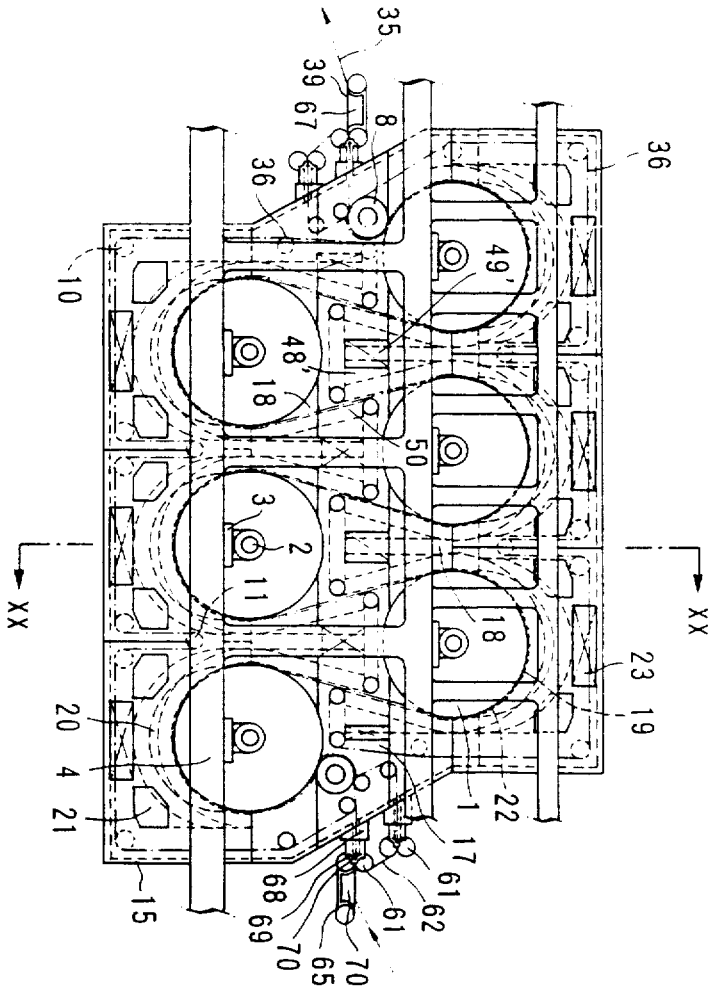
Figure 21:
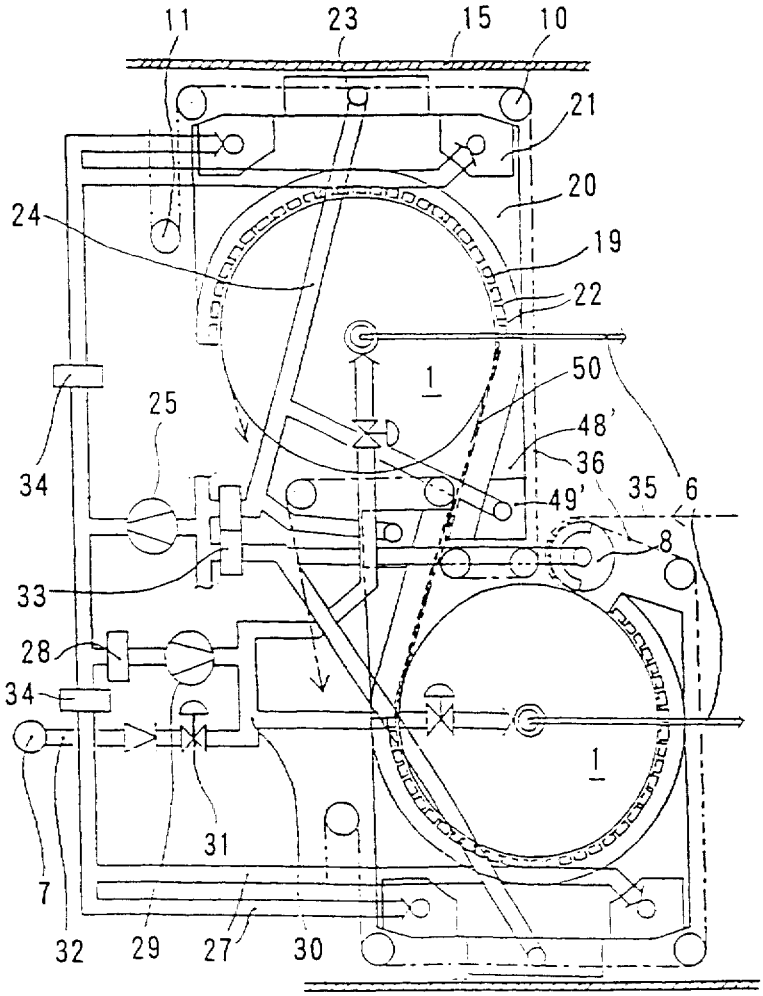
Figure 22:
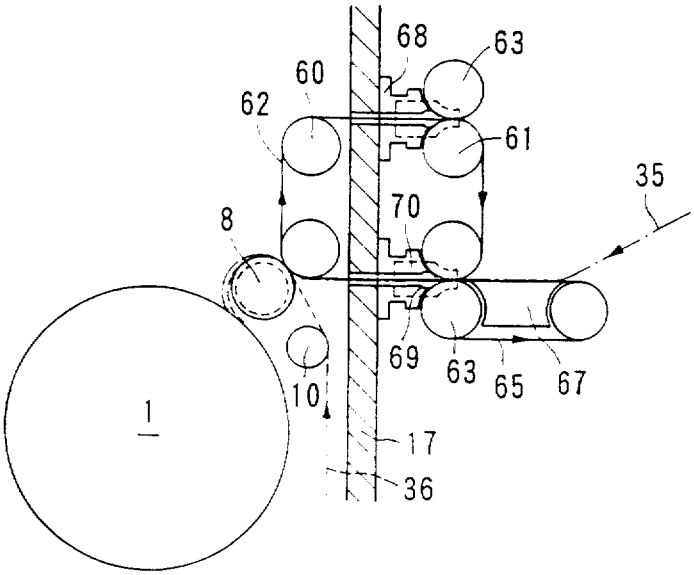
Figure 23:
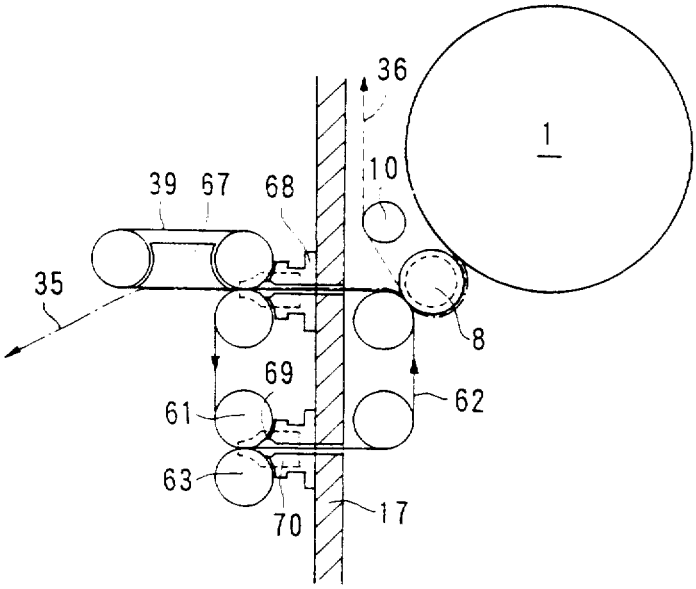

Moreover, FIGS. 19 to 21 depict a drying apparatus in accordance with a fifth embodiment of the invention, which differs from the fourth embodiment in that the paper web 35 is passed on each dryer cylinder 1 with the surface being held in intimate contact with the outer peripheral surface of the cylinder 1, and with the opposite surface being strongly pressed by the endless fabric belt 36 which is tensed by the fabric tension rolls 11.

More specifically, as in the fourth embodiment, sealing devices are provided at the entrance and the exit of the hood 17, respectively. The sealing devices to be used in the present embodiment are shown from FIGS. 22 to 25, and are basically similar to those of FIGS. 15 to 18. However, in the present embodiment, the upper endless fabric belt 36 is caused to travel around the upper row cylinders 1 and when released from the upper cylinder 1, it is guided by a suitable fabric roll to turn away from the path of the paper web towards the next cylinder 1, and returns and caused to run toward the adjacent upper cylinder. The lower endless fabric belt 36 is also caused to travel around the lower cylinders 1 and is guided to turn towards the next lower cylinder 1. Thus, one of the two endless fabric belts 36 is not used to sandwich the paper web when the paper web 35 sucked by the suction fabric roll 8 is caused to pass around the cylinder 1, and the paper web 35 is caused to pass around the cylinder 1 with one of the surfaces being directly contact with the outer peripheral surface of the cylinder 1 and with the other surface being pressed the other endless fabric belt 36.

In operation, a wet paper web 35 fed into the closed hood is sandwiched between the upper and lower endless fabric belts 36 travelling inside the closed hood to reach the first dryer cylinder 1 located at the entrance of the hood. The paper web 35 then passes on the dryer cylinder 1 with the top surface being held in intimate contact with the outer peripheral surface of the cylinder 1. The bottom surface of the paper web 35 is strongly pressed by the endless fabric belt 36 which is tensed by the fabric tension rolls 11. Thus, the paper web 35 is dried while restrained by the cylinder 1 and the fabric belt 36. When the paper web 35 passes over the first dryer cylinder 1, the paper web 35 is released from the first dryer cylinder 1 at the exit by being sucked through the suction ports 50 arranged at the side of the fabric belt 36, and travels on a straight plane while kept restrained by the suction ports 50 through the fabric belt 36 (lower fabric belt in the illustrated example). The paper web 35 then reaches the intermediate position between the adjacent lower and upper dryer cylinders 1, and is sandwiched for a while between the lower and upper fabric belts 26. Subsequently, the paper web 35 is released from the first (lower) fabric belt 36, and kept restrained on the other (upper) fabric belt 36 by the suction force of the suction ports 50 disposed adjacent thereto. Thus, the paper web 35 reaches the entrance of the next dryer cylinder 1 while kept restrained, and the drying process is repeated over again as described above.

Furthermore, as is the case with the fifth embodiment, the suction ports 50 and the suction boxes 48' which is connected with suction ducts 49' may be connected to escape devices 46 mounted on the dryer frames.

Moreover, although in the fourth embodiment, both the blow ports and the suction ports are arranged along the path of the paper web at a zone between the adjacent dryer cylinders, only the suction ports 50 are arranged between the adjacent dryer cylinders 1 in this embodiment. This is because, if the blow ports should also be provided, the paper web traveling between the adjacent dryer cylinders 1 may float away from the fabric belt by the blown drying medium, so that the restrained drying cannot be ensured. Thus, as clearly seen in FIG. 21, the blow ports are not provided between the adjacent dryer cylinders 1.

Although not shown, the sealing devices may be added to the second embodiment of the invention as shown in FIG. 6. Furthermore, instead of superheated steam atmosphere, a drying atmosphere of heated moist air may be produced in the sealed hood.

Obviously, many modifications and variations of the present invention are possible in the light of the above teachings. It is therefore to be understood that within the scope of the appended claims, the invention may be practiced otherwise than as specifically described.

Finally, the present application claims the priorities of the Japanese Patent Application No. 5-309774 filed Nov. 15, 1994, Japanese Patent Application No. 6-147060 filed Jun.

6, 1994, Japanese Patent Application No. 6-147059, Japanese Patent Application 6-278508 filed Oct. 17, 1994, Japanese Patent Application 6-278473 filed Oct. 18, 1994, and Japanese Patent Application 6-287469 filed Oct. 27, 1994 which are all incorporated herein by reference. With respect to the latter three Japanese patent applications, filing numbers are not fixed yet. However, they are all related to an apparatus and process for drying a sheet material.

What is claimed is:

1. An apparatus for drying a wet sheet material comprising:

a dryer frame assembly;

bearing devices mounted on said dryer frame assembly;

a plurality of dryer cylinders heating the sheet material, each of said dryer cylinders including a cylinder body having an outer peripheral surface and opposite end faces thereof and a pair of shaft portions formed at said opposite end faces, each dryer cylinder being rotatably arranged on said dryer frame assembly with said shaft portions being supported by said bearing devices;

an endless gas-permeable fabric belt associated with said dryer cylinders and cooperating with said dryer cylinders and transferring said sheet material, said fabric belt being looped around a respective dryer cylinder and pressing the sheet material towards the outer peripheral surface of said dryer cylinder to restrain the sheet material;

a transferring device associated with said dryer cylinders, said transferring device transferring the sheet material from a respective dryer cylinder to the dryer cylinder adjacent thereto while keeping the sheet material restrained;

a heat-insulated hood assembly arranged adjacent to said dryer cylinders and substantially surrounding said outer peripheral surfaces of said dryer cylinders, with said bearing devices being located outside and defining a narrow sealed dryer chamber, said heat-insulating hood assembly being at least partly movable between a closed position where the dryer chamber is substantially closed and an opened position where the dryer chamber is opened; and a drying medium-circulating device attached to said heat-insulated hood assembly, said medium-circulating device supplying into said hood assembly a drying medium producing a drying atmosphere in said dryer chamber and removing the steam evaporated from said sheet material through said gas permeable fabric belt to recover the steam for reuse, said drying medium being selected from the group consisting of a superheated steam of no less than 100° C. and a heated moist air of dew point of no less than 80° C.

2. A drying apparatus as defined in claim 1, wherein said dryer cylinders are disposed in a double row arrangement including an upper row of dryer cylinders and a lower row of dryer cylinders.

3. A drying apparatus as defined in claim 1, wherein said dryer cylinders are disposed in a single row arrangement including a single row of dryer cylinders.

4. A drying apparatus as defined in claim 1, wherein said heat-insulated hood assembly includes an upper hood, a lower hood and a middle hood interposed between said upper hood and said lower hood, at least one of said upper hood, said lower hood and said middle hood being movable between the open position and the closed position.

5. A drying apparatus as defined in claim 4, which comprises a pair of elevating devices each attached to a respective one of said upper hood and said lower hood, said elevating device moving the respective hood towards and away from the cylinders.

6. A drying apparatus as defined in claim 1, wherein said transferring device includes a plurality of suction fabric rolls each disposed adjacent to a respective associated one of the dryer cylinders and guiding the sheet material onto or away from the associated dryer cylinder.

7. A drying apparatus as defined in claim 1, wherein a pair of said endless gas-permeable fabric belts are provided, one of said endless gas-permeable fabric belts being looped around an associated one of said dryer cylinders while the other endless gas-permeable fabric belt is looped around the dryer cylinder disposed adjacent to said associated dryer cylinder, said pair of fabric belts substantially extending to an intermediate position between said one dryer cylinder and said other dryer, such that said pair of fabric belts serve as said transferring device.

8. A drying apparatus as defined in claim 1, wherein a pair of said endless gas-permeable fabric belts are provided and sandwich the sheet material therebetween, said pair of fabric belts being looped around a respective dryer cylinder and extending from a respective dryer cylinder to the dryer cylinder adjacent thereto, such that said pair of fabric belts serve as said transferring device.

9. A drying apparatus a defined in claim 1, wherein said drying medium-circulating device includes a suction device having a plurality of suction ports arranged along the path of the sheet material and sucking the steam evaporated from the sheet material.

10. A drying apparatus as defined in claim 1, wherein said drying medium-circulating device includes a blow device having a plurality of blower outlets arranged along a path of the sheet material blowing out the drying medium against the sheet material.

11. A drying apparatus as defined in claim 9, wherein said drying medium-circulating device further includes a plurality of circulating conduits connected to said suction device and reusing the recovered steam.

12. A drying apparatus as defined in claim 9, wherein said circulating conduits are connected to said blower device.

13. A drying apparatus as defined in claim 11, wherein said circulating conduits are further connected to said dryer cylinders to heat the same.

14. A drying apparatus as defined in claim 1, which comprises an entrance sealing device attached to said heat insulated hood assembly, said entrance sealing device admitting the sheet material into said hood assembly in sealing relation thereto, and an exit sealing device attached to said hood assembly and exiting the sheet material from the hood assembly in sealing relation thereto.

15. A drying apparatus as defined in claim 14, wherein each of said entrance sealing device and said exit sealing device includes at least two sealing rolls disposed inside and outside the hood assembly, respectively; and a sealing blanket looped around said at least two sealing rolls so as to pass through the hood assembly; a feeding roll disposed in association with one of said sealing rolls and guiding the sheet material therebetween, and a sealing member disposed between said feeding roll and said hood assembly and having a pair of convexly arcuate portions held in resilient contact with said feeding roll and the sealing roll associated therewith.

16. A drying apparatus as defined in claim 15, wherein said sealing device further comprises a pair of opposite sealing plates attached to the hood assembly so as to be held in sealing contact with opposite ends of said feeding roll and the sealing roll associated therewith.

17. A drying apparatus as defined in claim 6, further comprising a plurality of gas supply boxes disposed adjacent to said suction fabric rolls, each gas supply box including a surface facing a part of an outer peripheral surface of a respective suction fabric roll and having a plurality of blower ports formed in said surface blowing said drying medium towards said respective suction fabric roll.

18. A drying apparatus as defined in claim 17, wherein a pair of said suction fabric rolls are disposed adjacent to a respective dryer cylinder, said gas supply box being disposed between said pair of suction fabric rolls with said blower ports being directed towards both of said pair of suction fabric rolls.

19. A drying apparatus as defined in claim 6, further comprising a plurality of blower and suction devices disposed adjacent to a respective suction fabric roll, each of said blow and suction device including a plurality of gas-blow ports blowing the drying medium towards said respective suction fabric roll and a plurality of suction ports sucking the steam evaporated from the sheet material passing on said respective fabric roll.

20. A drying apparatus as defined in claim 3, further comprising a plurality of suction fabric rolls guiding the sheet material between adjacent dryer cylinders and a plurality of blowing and suction devices disposed adjacent to a respective suction fabric roll, each of said blower and suction device including a plurality of gas-blow ports blowing the drying medium towards said respective suction fabric roll and a plurality of suction ports sucking the steam evaporated from the sheet material passing on said respective fabric roll.

21. A drying apparatus as defined in claim 2, wherein said dryer frame assembly includes a front dryer frame disposed at an operational side of the drying apparatus, said front dryer frame including a lower frame portion supporting said lower row of dryer cylinders, an upper frame portion disposed above said lower frame portion and supporting said upper row of dryer cylinders, and an intermediate portion connecting said lower frame portion and said upper frame portion and being shifted from said upper and lower frame portions in a direction away from said cylinders.

* * * * *

UNITED STATES PATENT AND TRADEMARK OFFICE

CERTIFICATE OF CORRECTION

PATENT NO. : 5,647,141

DATED : July 15, 1997

INVENTOR(S) : Morimasa Hanaya

It is certified that error appears in the above-identified patent and that said Letters Patent is hereby corrected as shown below:

Delete drawing Figs. 3, 5-11, 13-15, 19 and 21-23 and substitute therefor the drawing sheets, consisting of Figs. 3, 5-11, 13-15, 19 and 21-23, as shown on the attached pages.

Signed and Sealed this

Twenty-third Day of June, 1998

*Attest:*

Bruce Lehman

BRUCE LEHMAN

*Attesting Officer*

*Commissioner of Patents and Trademarks*

US005647141A

United States Patent [19]

Hanaya

[11] Patent Number: 5,647,141

[45] Date of Patent: Jul. 15, 1997

[54] PROCESS AND APPARATUS FOR DRYING SHEET MATERIALS

[75] Inventor: Morimasa Hanaya, Mishima, Japan

[73] Assignee: Tokushu Paper Mfg. Co., Ltd., Shizuoka-ken, Japan

[21] Appl. No.: 643,016

[22] Filed: May 2, 1996

Related U.S. Application Data

[62] Division of Ser. No. 340,383, Nov. 15, 1994, Pat. No. 5,553,392.

[30] Foreign Application Priority Data

| | | | |
|---|---|---|---|
| Nov. 15, 1993 | [JP] | Japan | 5-309774 |
| Jun. 6, 1994 | [JP] | Japan | 6-147059 |
| Jun. 6, 1994 | [JP] | Japan | 6-147060 |
| Oct. 17, 1994 | [JP] | Japan | 6-278508 |
| Oct. 18, 1994 | [JP] | Japan | 6-278473 |
| Oct. 27, 1994 | [JP] | Japan | 6-287469 |

[51] Int. Cl.[6] ..... F26B 11/02

[52] U.S. Cl. ..... 34/115; 34/116

[58] Field of Search ..... 34/115, 114, 116, 34/117, 120, 121, 122

[56] References Cited

U.S. PATENT DOCUMENTS

| | | | |
|---|---|---|---|
| 2,477,949 | 8/1949 | Amonsen | 34/601 |
| 2,835,047 | 5/1958 | Fleissner et al. | 34/122 |
| 3,163,502 | 12/1964 | Justus et al. | 34/114 |
| 3,576,078 | 4/1971 | Holt | 34/114 |
| 3,956,832 | 5/1976 | Justus | 34/115 |
| 4,103,434 | 8/1978 | Walker | 34/114 |
| 4,116,022 | 9/1978 | Lopata et al. | 34/116 |
| 4,124,941 | 11/1978 | Birke et al. | 34/114 |

FOREIGN PATENT DOCUMENTS 8509529 10/1996 Japan .

*Primary Examiner*—Henry A. Bennett
*Assistant Examiner*—Dinnatia Doster
*Attorney, Agent, or Firm*—Oblon, Spivak, McClelland, Maier & Neustadt, P.C.

[57] ABSTRACT

An apparatus for drying a wet sheet material such as a paper web is presented. The apparatus is provided with a suitable number of dryer cylinders operating in conjunction with a plurality of steam blast ports disposed adjacent to the dryer cylinders. A vertically movable canopy hood and a middle hood having sheet entry/exit opening and a door opening device are provided. The wet sheet material is held between two endless fabric belts, and passed through the dryer cylinders alternatively via suction fabric rolls, fabric rolls and fabric tension rolls. The drying process is carried out in an atmosphere of superheated steam of over 100° C. inside the canopy hood and the middle hood, and the steam generated from the wet sheets is recirculated through an exhaust screen, a super heated steam circulating fan, an adiabatic compressor and a supply duct. Another atmosphere of heated moist air having a dew point of at least 80° C. is also employed.

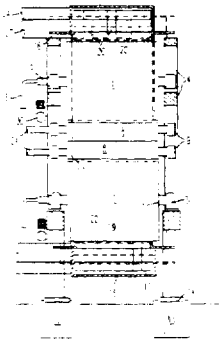

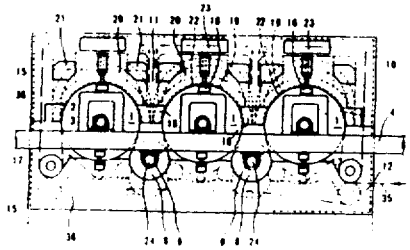

21 Claims, 21 Drawing Sheets